US007428948B2

(12) United States Patent
D'Antonio et al.

(10) Patent No.: US 7,428,948 B2
(45) Date of Patent: Sep. 30, 2008

(54) HYBRID AMPLITUDE-PHASE GRATING DIFFUSERS

(75) Inventors: Peter D'Antonio, Upper Marlboro, MD (US); Trevor J. Cox, Chorlton (GB)

(73) Assignee: RPG Diffusor Systems, Inc.MD (US)

( * ) Notice: Subject to any disclaimer, the term of this patent is extended or adjusted under 35 U.S.C. 154(b) by 522 days.

(21) Appl. No.: 11/201,067

(22) Filed: Aug. 11, 2005

(65) Prior Publication Data

US 2007/0034448 A1 Feb. 15, 2007

(51) Int. Cl.
*E04B 1/82* (2006.01)
*E04B 1/99* (2006.01)
*E04B 1/84* (2006.01)

(52) U.S. Cl. ..... 181/293; 181/292

(58) Field of Classification Search ..... 181/293, 181/292

See application file for complete search history.

(56) References Cited

U.S. PATENT DOCUMENTS

| | | | | | |
|---|---|---|---|---|---|
| 2,840,179 | A * | 6/1958 | Junger | ..... | 181/286 |
| 2,989,136 | A * | 6/1961 | Wohlberg | ..... | 181/224 |
| 3,035,657 | A * | 5/1962 | Lemon | ..... | 181/290 |
| 4,566,557 | A * | 1/1986 | Lemaitre | ..... | 181/150 |
| 4,821,839 | A * | 4/1989 | D'Antonio et al. | ..... | 181/198 |
| 4,964,486 | A * | 10/1990 | D'Antonio et al. | ..... | 181/285 |
| 5,027,920 | A * | 7/1991 | D'Antonio et al. | ..... | 181/285 |
| 5,160,816 | A * | 11/1992 | Chlop | ..... | 181/285 |
| 5,168,129 | A * | 12/1992 | D'Antonio | ..... | 181/30 |
| 5,193,318 | A * | 3/1993 | D'Antonio | ..... | 52/144 |
| 5,226,267 | A * | 7/1993 | D'Antonio | ..... | 52/144 |
| 5,401,921 | A * | 3/1995 | D'Antonio et al. | ..... | 181/286 |
| 5,512,715 | A * | 4/1996 | Takewa et al. | ..... | 181/295 |
| 5,817,992 | A * | 10/1998 | D'Antonio | ..... | 181/295 |
| 6,112,852 | A * | 9/2000 | D'Antonio et al. | ..... | 181/295 |
| 6,491,134 | B2 * | 12/2002 | Ryan et al. | ..... | 181/295 |
| 6,772,859 | B2 * | 8/2004 | D'Antonio et al. | ..... | 181/293 |
| 7,308,965 | B2 * | 12/2007 | Sapoval et al. | ..... | 181/210 |
| 7,314,114 | B2 * | 1/2008 | Gardner et al. | ..... | 181/293 |
| 7,322,441 | B2 * | 1/2008 | D'Antonio et al. | ..... | 181/293 |
| 2005/0167193 | A1 * | 8/2005 | Van Reeth | ..... | 181/293 |

FOREIGN PATENT DOCUMENTS

JP 02131296 A * 5/1990

* cited by examiner

*Primary Examiner*—Edgardo San Martin
(74) *Attorney, Agent, or Firm*—H. Jay Spiegel

(57) ABSTRACT

A room acoustic diffuser exploits interference, by reflecting waves out-of-phase with the specular energy, making it possible to diminish specular energy. This is achieved by using a diffuser based on a ternary sequence, which nominally has reflection coefficients of 0, −1 and +1. A method for obtaining the design sequence for Quaternary diffusers is also disclosed. Also, design methods for forming the sequences into arrays, and forming hemispherical diffusers are explained.

69 Claims, 18 Drawing Sheets

HYBRID AMPLITUDE-PHASE GRATING DIFFUSERS

BACKGROUND OF THE INVENTION

Diffusers can be used to improve the acoustics of enclosed spaces to make music more beautiful and speech more intelligible. Early research in diffusers began by considering non-absorbing reflection phase grating surfaces such as Schroeder diffusers. These surfaces consist of a series of wells of the same width and different depths. The wells are separated by thin dividers. The depths of the wells are determined by a mathematical number theory sequence that has a flat power spectrum such as a quadratic residue or primitive root sequence. More recent research has concerned the development of "diffsorbers" or hybrid absorber-diffusers; these are surfaces that are combinations of amplitude and phase gratings, where partial absorption is inherent in the design, and any reflected sound is dispersed.

A diffuser needs to break up the reflected wavefront. While this can be achieved by shaping a surface, as in a phase grating, it can also be achieved by changing the impedance of the surface. In hybrid surfaces, variable impedance is achieved by patches of absorption and reflection, giving pressure reflection coefficients nominally of 0 and 1, respectively. Unlike the Schroeder diffuser, these cannot be designed for minimum absorption. These surfaces are hybrids, somewhere between pure absorbers and non-absorbing diffusers.

The use of patches of absorption to generate dispersion is not particularly new. In studio spaces, people have been arranging absorption in patches rather than solid blocks for many years. In recent times, however, a new breed of surface has been produced, where the absorbent patches are much smaller, and the arrangement of these patches is determined by a pseudorandom sequence to maximize the dispersion generated. For instance, the Binary Amplitude Diffsorber, also known as a BAD panel, assigned to Applicants' Assignee, is a flat hybrid surface having both absorbing and diffusing abilities with the location of the absorbent patches determined by a Maximum Length Sequence (MLS). The panel simultaneously provides sound diffusion at high and mid b and frequencies, and crosses over to absorption below some cut-off frequency. In FIG. 1, a simple binary amplitude diffuser, based on an N=7 maximum length sequence {1110010}, is depicted. The white patches are made of hard material and are reflecting with a pressure reflection coefficient of 1 and the shaded patches are made of absorbent material and so are absorbing with a pressure reflection coefficient of 0. By changing the number of hard and soft patches on the surface, it is possible to control the absorption coefficient. By changing the ordering of the patches, it is possible to control how the reflected sound is distributed. If a periodic arrangement of patches is used, then the reflected sound will get concentrated in particular directions due to spatial aliasing; these are then grating lobes. If a good pseudo-random sequence is used to choose the patch order (say a Barker sequence), then the scattering will be more even. Applicants have described in U.S. Pat. No. 5,817,992 effective planar two-dimensional binary amplitude sequences.

A problem with planar hybrid absorber-diffusers is that energy can only be removed from the specular reflection by absorption. While there is diffraction caused by the impedance discontinuities between the hard and soft patches, this is not a dominant mechanism except at low frequencies. Even with the most optimal arrangement of patches, at high frequencies where the patch becomes smaller than half the wavelength, the specular reflection is only attenuated by roughly 7 dB, for a surface with 50% absorptive area, because 3/7ths of the surface forms a flat plane surface, which reflects unaltered by the presence of the absorptive patches.

If it were possible to exploit interference, by reflecting waves out-of-phase with the specular lobe, then it would be possible to diminish the specular lobe further.

Applicants have found that this can be achieved by using a new class of hybrid diffusers combining the aspects of an amplitude grating with those of a reflection phase grating. These new surfaces contain the elements of an amplitude grating, namely, reflective and absorptive patches, with the addition of a additional reflective patches, in the form of wells a quarter wavelength deep at the design frequency, which can constructively interfere with the zero-depth reflective patches. The simplest form of these hybrid gratings is an absorber-diffuser with a random or pseudo-random distribution. But a more effective design is based on a ternary sequence, which nominally has surface reflection coefficients of 0, 1 and −1. The wells with the pressure reflection coefficient of −1 typically have a depth of a quarter of a wavelength at the design frequency and odd multiples of this frequency to produce waves out of phase with those producing the specular lobe, i.e. the wells with a pressure reflection coefficient of +1. This results in a better reduction of the specular reflection. By contrast with the N=7 binary sequence {1110010} with three purely reflective elements, which offers 7 dB [20*log (3/7)] of specular attenuation, an N=7 ternary sequence {1 1 0 1 0 0 −1} with two remaining purely reflective elements due to cancellation of a 1 and −1, offers 11 dB [20*log (2/7)] of attenuation. Ternary sequences are therefore an extension of the binary amplitude diffuser and are an alternative way of forming hybrid absorber-diffusers, which achieve superior scattering performance for a similar amount of absorption, as the BAD panel. As will be described, there are other sequences and approaches, using both single plane and hemispherically scattering designs.

SUMMARY OF THE INVENTION

The present invention includes the following interrelated objects, aspects and features:

The present invention relates to a new class of hybrid absorber-diffuser consisting of a series of absorptive patches (with a pressure reflection coefficient of 0), reflective patches (with a pressure reflection coefficient of +1) and quarter wavelength deep wells at the design frequency and odd multiples of this frequency (with a pressure reflection coefficient of −1). The ordering of the pressure reflection coefficients can be arbitrary, i.e., using a random or pseudo-random distribution, but more effective performance can be achieved using a ternary or quaternary number theory sequence. A Ternary sequence of 0, 1 and −1s is used to specify the order of the patches to control how the reflected sound is distributed. This new combined amplitude and phase grating can best be described by an example based on a simple 7 element Ternary sequence {1 1 0 1 0 0 −1}, as shown in FIG. 2, where the white patches are made of hard material and are reflecting, and the shaded patches are made of absorbent material and so are absorbing. The last well is a quarter of a wavelength deep to provide a reflection coefficient of −1. Since the final well has a depth of a quarter of a wavelength, at the design frequency and odd multiples of this frequency, the final well presents a reflection coefficient of −1 to the incoming wave. Therefore, the surface reflection coefficient distribution is a sequence of −1, 0 and +1s. The well with a reflection coefficient of −1 produces waves out of phase with those producing the specular lobe, the wells with a reflection coefficient of +1. This enables better reduction of the specular lobe, as compared to a binary amplitude diffuser.

If a periodic arrangement of patches is used, then the autocovariance will contain a series of peaks, and so the autospectrum will also contain a series of peaks. This then means that for each frequency, the reflected sound will be concentrated in particular directions due to spatial aliasing; these are grating lobes. If a good pseudo-random sequence is used to choose the patch order, one with a delta-function like autocovariance—say a Barker sequence—then the scattering will be more even. However, whatever the arrangement of the patches, at high frequency, the N=7 binary sequence {1110010} with three purely reflective elements offers 7 dB [20*log (3/7)] of specular attenuation. By contrast, an N=7 ternary sequence {1 1 0 1 0 0 −1} with two remaining purely reflective elements, offers 11 dB [20*log (2/7)] of attenuation. Ternary sequences are therefore an extension of the binary amplitude diffuser and are an alternative way of forming hybrid absorber-diffusers that achieve superior scattering performance for a similar amount of absorption, as the BAD panel. The disclosure describes design and optimization methodology for a short N=7 ternary sequence for descriptive purposes and illustrates performance, using a simple far field theory. The design methodology is also given for a longer N=31 ternary diffuser, which offers better performance and has practical architectural acoustic applications. Improvements in performance due to modulation are illustrated and further proof of performance illustrations is presented, using a very accurate Boundary Element modeling. Ternary sequences offer improvement over binary amplitude diffusers primarily at the design frequency and odd multiples thereof. Three methods to improve on this performance are described. The first is to modify the shape of the −1 wells of the ternary diffuser from flat to ramped and/or folded. Adding the ramp introduces additional quarter wave depths providing a hybrid amplitude-polyphase absorber-diffuser that provides interference at additional frequencies and odd multiples thereof. The second is to bend the quarter wavelength deep wells into "L" or "T" shapes, extending the interference to lower design frequencies and odd multiples thereof, without increasing the depth. Lastly, quaternary sequence diffusers can be used in which one additional phase is added giving 0, 1, −1 and ξ. By properly adjusting this additional phase to provide interference at even multiples of the design frequency, more uniform diffusion is provided. So far, we have described one-dimensional diffusers consisting of strips of reflective and absorptive elements, providing diffusion in a single plane. To provide uniform hemispherical scattering, the invention describes design methodologies for forming two dimensional ternary sequence arrays, using folding techniques, binary and ternary modulation and periodic multiplication. A 21×6 ternary array generated by periodic multiplication is described, which can be formed into a 21×24 sequence hemispherically scattering diffuser, which has architectural acoustic applications. An alternative approach that also provides uniform hemispherical diffusion is described, which utilizes a variety of polyphase broadband interference inserts into the rear absorptive backing of a binary amplitude diffuser. These modifications of the BAD panel also have architectural acoustic applications.

OBJECTS OF THE INVENTION

As such, it is a first object of the present invention to provide a hybrid absorber-diffuser combining the attributes of a binary amplitude grating, consisting of a series of absorbing and reflecting patches and a reflection phase grating, consisting of a series of equal width divided wells, having depths determined by a number theory sequence having a flat power spectrum.

It is a further object of the present invention to form a variable impedance surface consisting of reflective, absorptive and quarter-wave deep patches, having pressure reflection coefficients of 0, 1 and −1, respectively.

It is a further object of the present invention to choose the absorptive areas to achieve roughly 50% absorption at high frequencies above 5 kHz and transition from absorption to diffusion at roughly 1-2 kHz.

It is a further object of the present invention to arrange and distribute the pressure reflection coefficients of 0, 1 and −1 randomly or pseudo-randomly or with a ternary or quaternary number theory sequence for higher, predictable performance.

It is a further object of the present invention to describe short 1-dimensional ternary sequence diffusors designed, using optimization theory with a prescribed number of zeros to form surfaces with roughly 50% absorption.

It is a further object of the present invention to describe how modulation techniques can be used to improve the diffusion of ternary and extended ternary-polyphase diffusers.

It is a further object of the present invention to disclose longer one-dimensional ternary sequence diffusers designed using ternary number theory techniques.

It is a further object of the present invention to disclose an N=31 embodiment of a correlation identity derived ternary sequence diffuser.

It is a further object of the present invention to disclose slanted or other shape modifications to the flat quarter wavelength −1 wells to provide more uniform diffusion over additional frequencies and odd multiples thereof below the design frequency of the deepest previously flat −1 well.

It is a further object of the present invention to disclose folded or bent "L" or "T" shaped modifications to the flat quarter wavelength −1 wells to extend the length of the well, without increasing the physical depth of the diffuser, to provide more uniform diffusion at lower design frequencies and odd multiples thereof.

It is a further object of the present invention to disclose Quaternary diffusers, with two types of interfering wells, based on number theory sequences to provide interference at odd and even multiples of the design frequency and multiples thereof, thereby providing more uniform diffusion.

It is a further object of the present invention to disclose designs of hemispherically scattering hybrid absorber-diffusers.

It is a further object of the present invention to disclose designs of hemispherically scattering hybrid absorber-diffusers, using folding techniques that convert 1-dimensional ternary sequences to 2-dimensional sequences.

It is a further object of the present invention to disclose designs of hemispherically scattering hybrid absorber-diffusers, using binary and ternary modulation and periodic multiplication of ternary sequences.

It is a further object of the present invention to disclose fabrication techniques to implement the design of a 21×24 hemispherically scattering hybrid absorber-diffuser designed by array manipulation of a ternary 21×6 sequence derived from periodic multiplication of two appropriate MLS sequences. Circular holes are used to describe the design, realizing that the holes can assume any cross-section.

It is a further object of the present invention to disclose designs and fabrication embodiments of modified hemispherically scattering binary amplitude diffusers, which are converted into amplitude-polyphase hybrids, by insertion of one of four different polyphase inserts into the rear absorptive backing panel. Circular holes are used to describe the design, realizing that the holes can assume any cross-section.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Short One Dimensional Ternary Sequences

To compare the performance of unipolar binary and ternary sequences, it is necessary to construct some diffusers for comparison, and for this, sequences with the best patch order are needed. For diffusers with a small number of patches, it is possible to find the best sequences by an exhaustive search of all possible combinations. It is well established that the autocovariance (or autocorrelation function) of the surface reflection factors relates to the evenness of the scattering in the far field, with the autocovariance, which most resembles the delta function being best. Consequently, a computer may be tasked to search though all possible combinations of the reflection coefficients and find the one with the best autocovariance function. To do this search, the computer requires a number to judge the quality of the sequence, and this is provided by a merit factor. The merit factor used to judge the quality of the autocovariance function is different for unipolar binary and ternary sequences. For the unipolar case, there can be no cancellation within the side lobes of the autocovariance, because the reflection coefficients are either 0 or 1; in this case, the merit factor used for optical sequences is appropriate. If the autocovariance of the reflection coefficients is, $S_{nm}$, then the merit factor, F, is:

$$F=\max(S_{nm})|n|>0 \tag{1}$$

For the ternary sequence, there can be cancellation in the autocovariance side lobes, and so the appropriate merit factor is total side lobe energy:

$$F=\sum_{n,|n|>0} S_{nn} \tag{2}$$

One final constraint on the search is required. There are many combinations of patches that are not allowable, because they are too absorbing or too reflecting, for example, they have just absorbing or just reflecting patches. Consequently, it is necessary to decide how many absorbing and how many reflective elements there should be, and only choose those that are appropriate. It is assumed that the R=−1 wells are non-absorbing, however, as we shall see later, they can generate absorption by putting significant energy into the reactive field in conjunction with the R=1 patches. In the results presented below, the simple ternary sequence had 4 reflecting elements and 3 absorbing elements {1 1 0 1 0 0 −1}. The binary sequence shown in FIG. 1 and the ternary sequences shown in FIGS. 2A-C are the result of this type of search; however, there are many more possible sequences of equally good merit.

Figure 1:
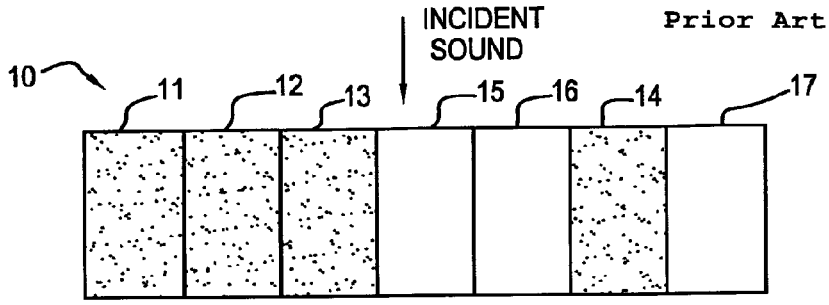
FIG. 1 shows a schematic representation of a simple prior art binary amplitude diffuser (BAD).

FIG. 1 shows a diffuser 10 including a binary sequence of reflecting and absorbing elements. The absorbing elements are designated by the reference numerals 11, 12, 13 and 14 (R=0), whereas the reflecting elements are designated by the reference numerals 15, 16 and 17 (R=+1).

Figure 2A:
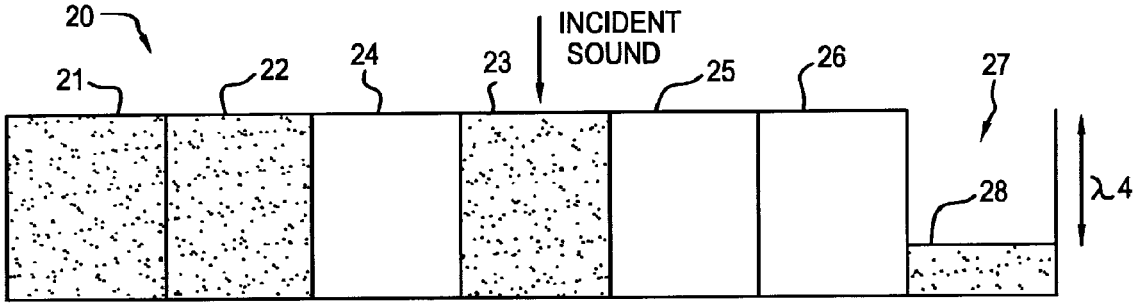
FIGS. 2A-2C show schematic representations of three designs of a simple ternary sequence diffuser.
Figure 2B:
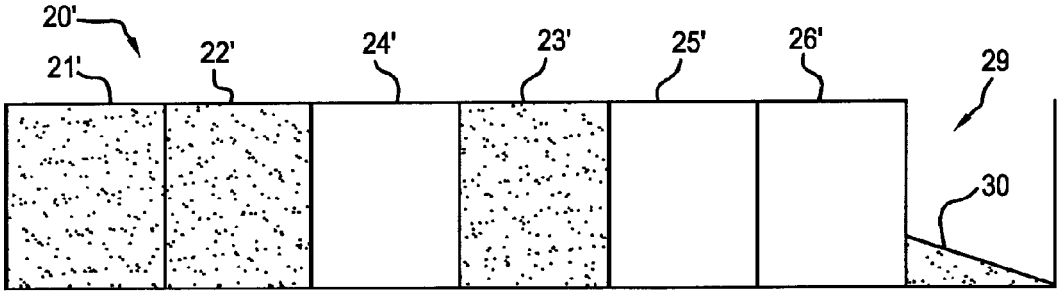
Figure 2C:
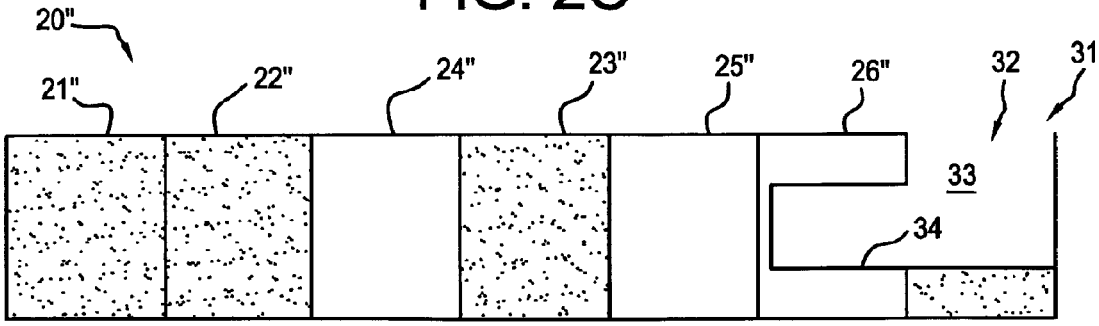

FIGS. 2A-C show three examples of diffusers 20, 20' and 20", respectively, each of which includes a ternary sequence. With reference to FIG. 2A, the diffuser 20 includes absorbing elements 21, 22 and 23 (R=0), reflecting elements 24, 25 and 26 (R=+1) and a quarter well 27 (R=−1) that is out-of-phase with the other elements and thus reduces the specular lobe of sound hitting the diffuser 20. The quarter well 27 includes a flat surface 28 that is generally parallel to the facing surfaces of the elements 21-26.

With reference to FIG. 2B, the diffuser 20' includes absorbing elements 21', 22' and 23' (R=0), reflecting elements 24', 25' and 26' (R=+1), and quarter well 29 that includes a surface 30 angled with respect to the facing surfaces of the elements 21'-26'. The quarter well 29 performs the same function as described above with respect to the quarter well 27, namely, it is out-of-phase with the elements 21'-26' and thereby reduces the specular lobe of sound received by the diffuser 20'.

FIG. 2C shows a diffuser 20" including absorbing elements 21", 22" and 23" (R=0), reflecting elements 24", 25" and 26" (R=+1), and horizontally elongated quarter well 31. The well 31 includes an opening 32 and an expanded chamber 33 that extends into the body of the element 26". The well 32 includes a bottom surface 34 that is generally parallel to the facing surfaces of the elements 21"-26". The well 32 is L-shaped in configuration as shown. The function of the well 32 is analogous to that of the wells 27 and 29.

Figure 3A:
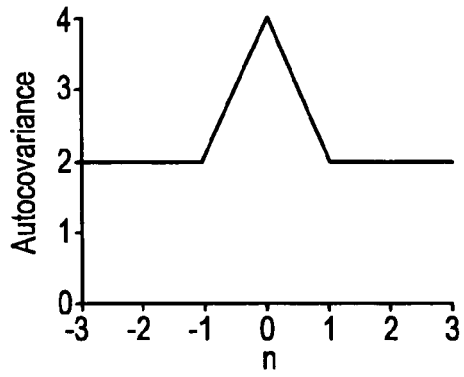
FIG. 3A shows a graphs of autocovariance for a unipolar binary sequence.
Figure 3B:
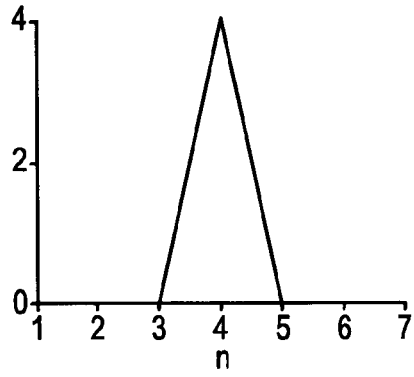
FIG. 3B shows a graph of autocovariance for a ternary sequence.

The autocovariance indicates the type of advantages that it might be expected that ternary sequences would have over unipolar binary sequences when used in diffusers. The autocovariance function for the ternary sequences shown in FIGS. 2A-C is shown in FIG. 3B, and for the unipolar binary sequence in FIG. 3A. The binary sequence is optimal in the sense that the side band autocovariance is a constant; however, the side band values are not perfect because they are greater than zero. This means that such sequences will have a specular component in their polar pattern. Perfection can be achieved using a ternary sequence as shown in FIG. 3B, where the sideband values are all zero.

Figure 4A:
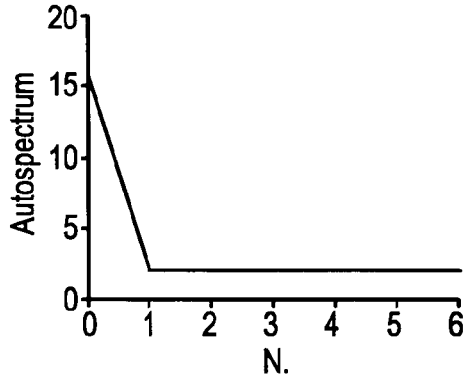
FIG. 4A shows autospectra for a unipolar binary sequence.
Figure 4B:
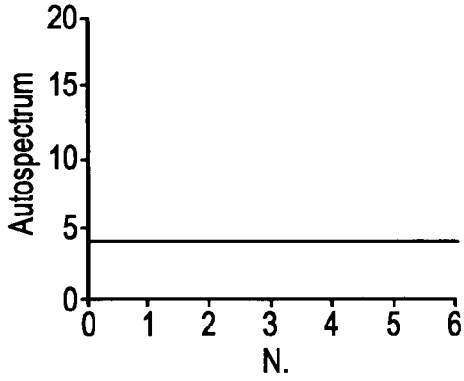
FIG. 4B shows autospectra for a ternary sequence.

In terms of scattering, the ternary sequence has the better reflection coefficient autospectra because it is constant; this is shown in FIG. 4B. It would be anticipated that the scattering from the ternary sequence would be more even with reflection angle if one repeat of the device was tested. For a periodic structure, one where many repeats of the diffuser are placed side by side, but not an infinite number, this will translate to a case where the scattered energy lobes are the same for the ternary sequence, whereas for the binary sequence, the specular lobe will have a different level to the other lobes; it will be less suppressed.

Figure 5:
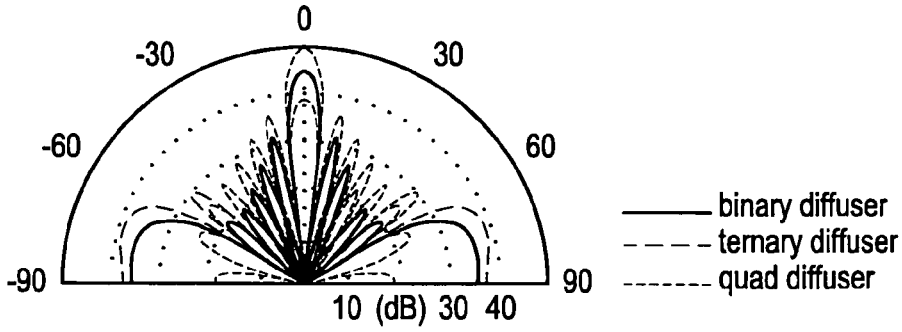
FIG. 5 shows a graph depicting scattering from three surfaces, a binary amplitude diffuser and a ternary diffuser at their design frequency and a planar surface.

FIG. 5 shows the scattering from the ternary and unipolar binary diffusers alongside the scattering from a plane surface. A simple Fourier prediction is used. Each patch is set to be 10 cm wide. This is at the frequency where the well depth of the ternary sequence is exactly a quarter wavelength; this will be referred to as the design frequency, $f_0$. This shows the behavior expected from the autospectra. The ternary diffuser has three lobes all of the same energy, whereas the specular lobe is not so well suppressed by the unipolar binary diffuser.

Figure 6:
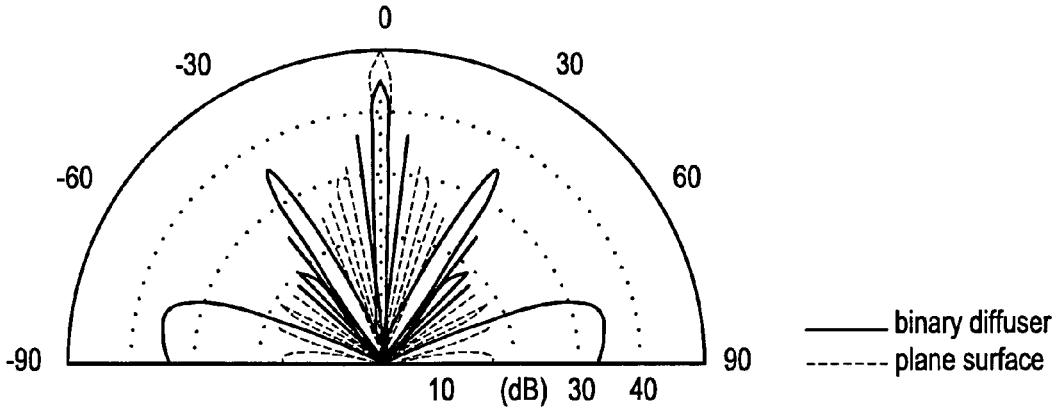
FIG. 6 shows polar response from the three surfaces described in FIG. 5, but at twice the designed frequency.
Figure 7:
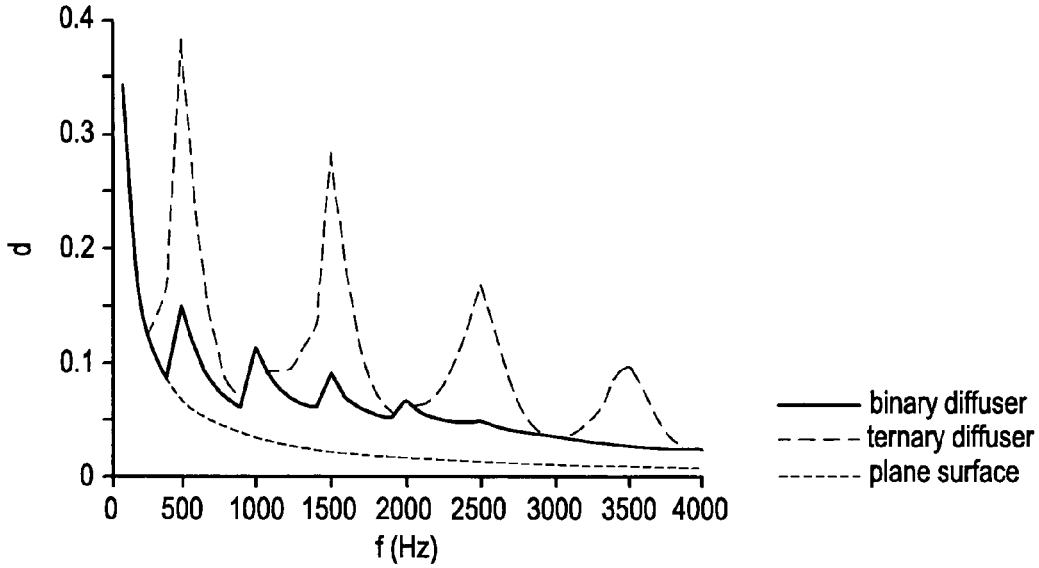
FIG. 7 shows the diffusion coefficient for the two diffusers described in FIGS. 1 and 2 and a plane surface.

FIG. 6 shows the case one octave higher. At this frequency the last well in the ternary sequence no longer provides a reflection coefficient of −1. Now the well is half a wavelength deep and the reflection coefficient is +1. In fact, the sequence of reflection factors is now the same as for the unipolar binary sequence, and hence the two diffusers in FIG. 6 have identical scattering. Consequently, the results show that the ternary diffuser provides better scattering than the unipolar binary diffuser at odd multiples of the design frequency, and to offer the same scattering at even multiples of the design frequency. This trend continues at higher frequencies as illustrated by the plot of diffusion coefficient verses frequency in FIG. 7. The diffusion coefficient is evaluated using AES-4id-2001 and a higher value indicates better dispersion. There are a couple of things we can do to the −1 well in this simple example. If we segment it into steps or slant it, each progressively deeper step provides a −1 reflection coefficient at progressively lower design frequencies and odd multiples of this frequency. This would introduce into FIG. 7 additional spikes at different design frequencies and odd multiples thereof. In addition, if we wanted to lower the design frequency further, in effect shifting the spiked diffusion response to lower frequency, we could introduce a folded well at the end. This has been shown to be effective in non-absorbing diffusers as well.

So far, the performance has only been discussed at multiples of the design frequency. Between the harmonics of the design frequency, the phase of the reflection coefficient offered by the well of fixed depth is neither exactly 180° nor 0°. The waves reflecting from this well will be partly out-of-phase with the waves from other parts of the diffuser with R-32 +1. Consequently, the performance is improved over the unipolar binary diffuser for these in-between frequencies, a finding confirmed by FIG. 7.

Modulation and Periodicity

The overall performance could be improved at many frequencies by removing the periodicity as this would remove the defined periodicity lobes caused by spatial aliasing. This could either be achieved by using much longer sequences or by modulating two sequences. Using one long sequence is normally avoided because of manufacturing cost, and so the use of two-sequence modulation is considered here.

For Schroeder diffusers, one method is to modulate a diffuser with its inverse. Two sequences are chosen which produce the same magnitude of scattering, but with opposite phase. So if the first ternary sequence is {1 1 0 1 0 0 −1}, then the complementary sequence used in modulation is the inverse of this {−1 −1 0 −1 0 0 1}. Given these two base diffusers, then a pseudo-random sequence is used to determine the order of these on the wall. This then reduces the periodicity.

Figure 8:
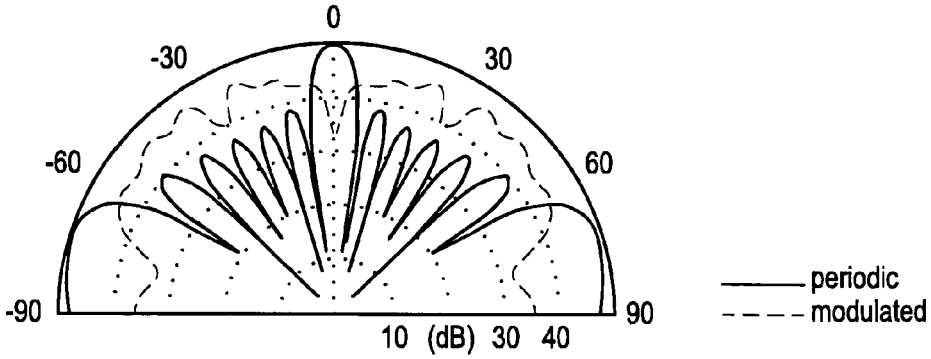
FIG. 8 shows a graph of the polar response from a periodic and modulated ternary diffuser at the design frequency.
Figure 9:
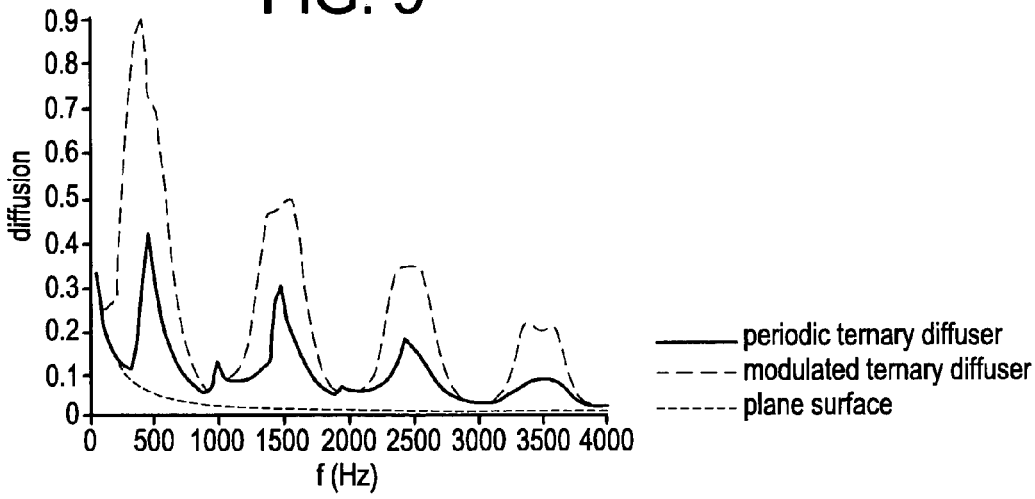
FIG. 9 shows the diffusion coefficient spectra from the three surfaces identified therein.

FIG. 8 shows the scattering at the design frequency for a periodic and modulated arrangement of the ternary sequences illustrating the removal of the three lobes when using modulation. FIG. 9 shows the diffusion coefficient verses frequency. This shows the great improvement that modulation can give, but only over selected bandwidths. At twice the design frequency, the two base shape reflection coefficients become identical, and so this returns to being a periodic structure with lobes within the polar response as shown previously in FIG. 6. Consequently, while inverting a sequence is good for modulating Schroeder diffusers, such as quadratic residue diffusers, they are not as useful here.

Single asymmetric modulation is where a single sequence is used, but the order of the sequence is reversed between different diffusers. For example, if the first ternary sequence is {1 1 0 1 0 0 −1}, then the second sequence used in modulation is {−1 0 0 1 0 1 1}. The advantage of this method is that only one base shape needs to be made. At even multiples of the design frequency, the reflection coefficients all revert to 0 and 1, but the structure will not be completely periodic. However, it is found that periodicity is only partly removed, and that the grating lobes are still present. The reason for this is that at these frequencies, the two sets of reflection coefficient are very similar. Consequently, when choosing a sequence for asymmetrical modulation, it is necessary to find which are as asymmetrical as possible at multiples of the design frequency. This is easier to achieve with longer sequences.

Boundary Element Modelling

Having established the general principles of performance, more exacting predictions will be presented using Boundary Element Methods (BEMs). BEMs have been shown to give accurate results for hybrid surfaces before when compared with measurements. The model used here is a 2D BEM based on the standard Helmholtz-Kirchhoff integral equation. The open well in the ternary diffuser is modeled assuming plane wave propagation in the well, and using an element at the well entrance with the appropriate impedance assuming rigid boundary conditions in the well. For the absorptive patches, the impedance was modeled using the Delaney and Bazley empirical formulation with a flow resistivity of $\sigma$=50,000 $Nm^{-4}$ and a porosity of 0.98. The scattering was predicted in the far field and will be displayed as ⅓ octave scattered level polar responses. The source was normal to the surface.

So far, the predictions have shown that the ternary diffusers are at least as good as the unipolar binary sequences, and for many sequences they are better. The size of the patches have been relatively large compared to commercial hybrid absorber-diffusers, because this enabled the number of patches/period to be small, and therefore an understanding of how these surfaces behave to be developed. In these BEM models, devices more commercially realistic will be considered.

Two diffusers were constructed and predicted. The first was an N=31 unipolar binary diffuser based on a maximum length sequence. A little over ten periods of the device were used in the prediction, and the patch width was 2 cm. The total diffuser width was 6.3 m. The second diffuser was an N=31 ternary diffuser, with the same overall dimensions and patch size. The wells with (nominally) R=−1 were set to be 8.5 cm deep, so the design frequency was 1 kHz.

Results

Figure 10:
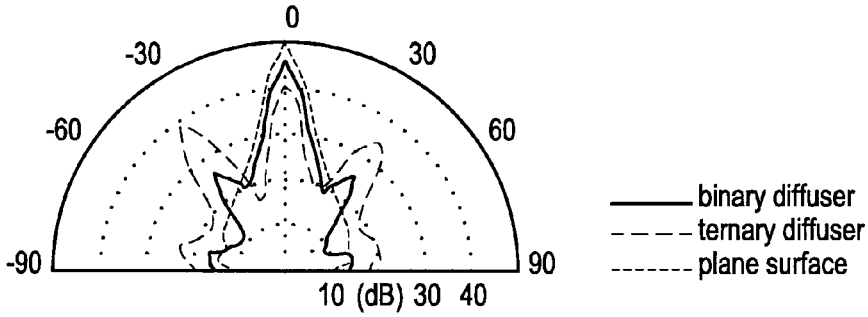
FIG. 10 shows a graph of scattering from the three surfaces identified at the design frequency.
Figure 11:
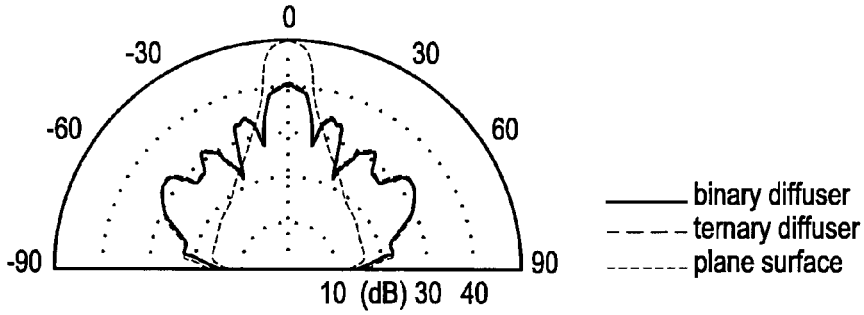
FIG. 11 shows scattering from the three surfaces identified at twice the design frequency.

FIG. 10 shows the scattering from the unipolar binary and ternary diffuser for the ⅓ octave band centered on the design frequency. FIG. 11 shows the scattering at an octave above. The results confirm the simple analysis provided earlier. At even multiples of the design frequency, such as shown in FIG. 11, the scattering from the unipolar binary and ternary diffusers is similar. At odd multiples of the design frequency, such as FIG. 10, the ternary diffuser offers more even scattering and a reduced specular lobe. It is also found that at frequencies, which are not multiples of the design frequency, the ternary diffuser is better than the unipolar binary diffuser.

Figure 12:
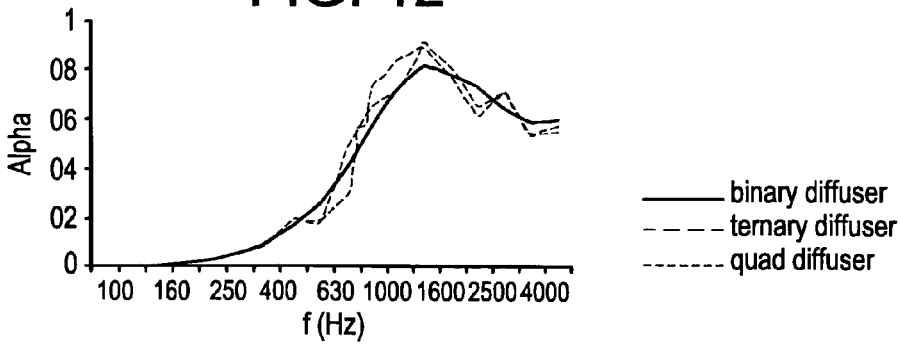
FIG. 12 shows a graph of the absorption coefficient for the three surfaces identified therein.

Using the Boundary Element results, it is possible to estimate the absorption provided by the surfaces. FIG. 12 shows this result for normal incidence. The graph is typical for hybrid absorber-diffusers. The low frequency response is dominated by the onset of the absorption provided by the absorbent backing. At high frequency, the absorption coefficient is determined by the open area at about 0.5. The system is essentially a perforated resonant absorber, so there is a peak of absorption at mid-frequencies. The absorption coefficient response is less smooth for the ternary diffuser. It is assumed that this is due to the fact that the reflections from the R=−1 wells provide out-of-phase reflections when compared to other parts of the diffuser, and therefore the waves can combine to put energy into the reactive field. Overall, however, the absorption is similar for all diffuser types.

Larger One-Dimensional Ternary Diffusers

With a larger number of patches, it is not possible to construct the ternary diffuser by searching all combinations. Consequently, methods from number theory must be drawn upon to give a construction method that produces a sequence with ideal autocovariance properties. However, many of the ternary sequences that have been generated are inappropriate, because they do not have the right balance of −1,0 and +1 elements. For example, Ipatov derived a class of ternary sequences with perfect autocovariance properties, i.e., ones where the side band energies were all zero. However, the sequences have very few zero elements in them, being dominated by −1 and +1 terms. Consequently, diffusers made from these sequences would be insufficiently absorbing. For example, the N=993 sequence would have a nominal absorption coefficient of 0.03. This problem arises because most applications of number theory what to maximize the efficiency of the binary sequence, efficiency in this context meaning the power carried by a signal based on the sequence. In the case of hybrid surfaces, most zero terms are required in a sequence; fortunately, there is one method that can achieve this.

Correlation identity derived ternary sequences, which are formed from two Maximum Length Sequences (MLS) have a nominal absorption coefficient near to 0.5 provided the design parameters are chosen correctly and the length of the sequence required follows certain rules, and so these are much more useful in the context being used here.

To take an example construction, first it is necessary to find a pair of MLS with low cross-covariance. The process is to form an MLS, and then sample this sequence at a different rate to form the complementary sequence, for example if the sample rate is $\Delta n=2$, then every second value from the original signal is taken. The following rules are followed:

1. The order of the maximum length sequences is $m \neq 0 \bmod 4$;
2. The length of the sequences is therefore, $N=2^m-1$;
3. The sample rate $\Delta n$ is chosen using either $\Delta n=2^k+1$ or $\Delta n=2^{2k}-2^k-1$;
4. A parameter e is defined as e=gcd(m,k) where gcd( ) is the greatest common divisor. This must be chosen so that m/e is odd and so to give the correct distribution of cross-covariance values.

Under these conditions, the two maximum length sequences have a cross-covariance $S_{ab}(n)$ which has three values defined by:

$$S_{ab}(n)=\begin{cases}-1+2^{(m+e)/2} & \text{occurs } 2^{m-e-1}+2^{(m-e-2)/2} \text{ times}\\ -1 & \text{occurs } 2^{m}-2^{(m-e)}-1 \text{ times}\\ -1-2^{(m+e)/2} & \text{occurs } 2^{m-e-1}-2^{(m-e-2)/2} \text{ times}\end{cases} \quad (6)$$

The total number of 1s and −1s in the sequence will be given by $\approx N(1-2^{-e})$. This is therefore the amount of reflecting surface on the diffuser, and so at high frequency, when the wavelength is smaller than the patch size, we would anticipate an absorption coefficient of $1-2^{-e}$ for the ternary diffuser. If the aim is to achieve a diffuser with an absorption coefficient of ≈0.5, this means that e=1.

Consider $N=31=2^5-1$. e is required to be a divisor of m so that m/e is odd—see point 4 above—and this can be achieved with k=1 as this makes e=gcd(k,m)=1 and m/e=1 which is odd. Point 3 above, then gives the possible sample rates as Δn=3.

The first part of the first MLS used was:

1 0 0 0 0 1 0 0 1 0 . . .

Taking every 3rd value then gives the second MLS starting with:

1 0 0 0 0 1 1 0 0 1 0 . . .

This then gives a cross-covariance where:

$$S_{ab}(n)=\begin{cases}7 & \text{occurs } 10 \text{ times}\\ -1 & \text{occurs } 15 \text{ times}\\ -9 & \text{occurs } 6 \text{ times}\end{cases} \quad (7)$$

The ternary sequence, $c_n$, is formed from the cross-covariance between the two MLS—a rather surprising and remarkable construction method. Each element of the cross-covariance plus one, i.e. $S_{ab}(n)+1$, is divided by $2^{(m+e)/2}$ to gain a perfect sequence with an in-phase value of $2^{m-e}$.

$$S_{cc}(n)=\begin{cases}2^{m-e} & n=0\\ 0 & n\neq 0\end{cases} \quad (8)$$

Applying this to the above pair of sequences yields the Ternary sequence, shown in FIGS. 13, 14 and 15, with flat, slanted and folded R=−1 wells, respectively:

{0 0 1 1 −1 1 −1 0 0 0 1 1 0 1 −1 −1 0 1 0 −1 0 0 0 0 −1 0 0 1 0 1 1} which has a perfect autocovariance with sidebands of zero.

Figure 13A:
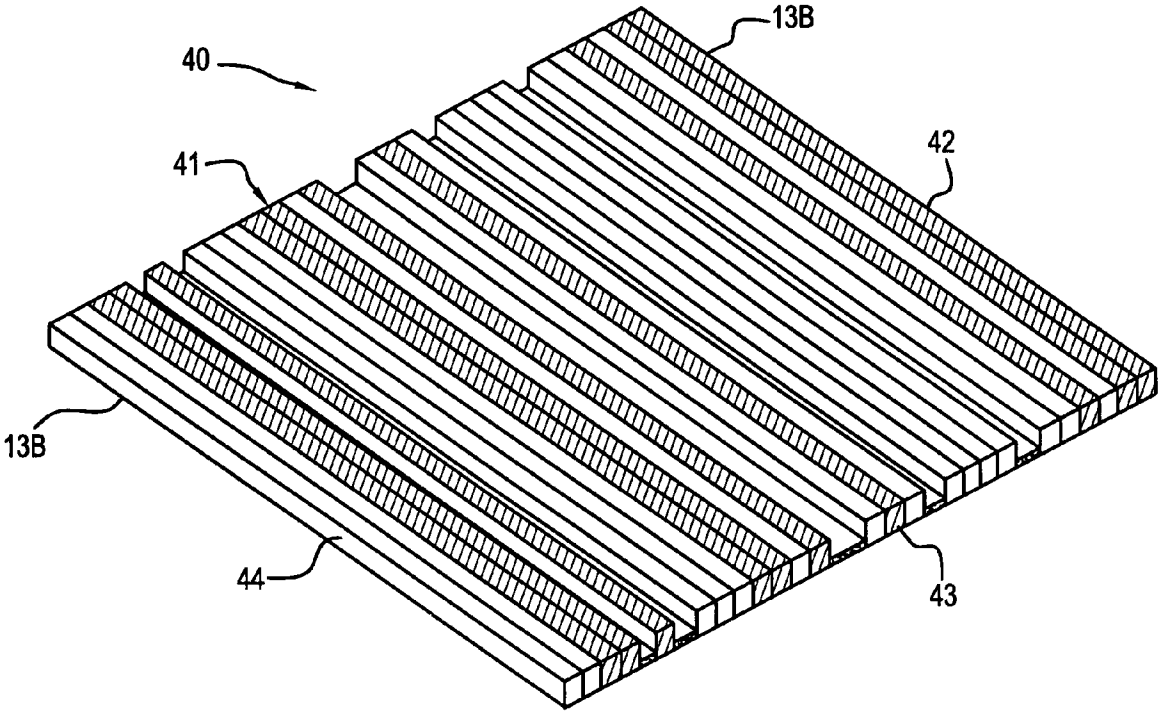
FIGS. 13A and 13B show isometric and section views, respectively, of an embodiment for an N=31 ternary diffuser with flat wells, which scatters in a single plane.
Figure 13B:
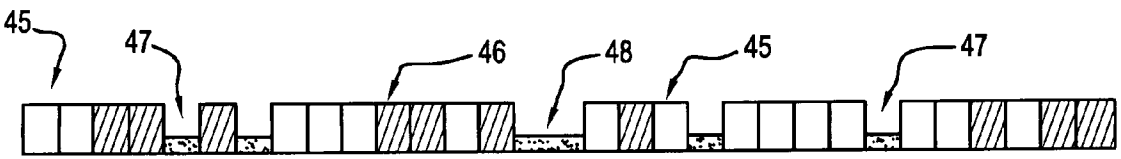

FIGS. 13A and 13B show an N=31 ternary diffuser generally designated by the reference numeral 40 and including a generally rectangular shape defined by walls 41, 42, 43 and 44. As best seen with reference to FIG. 13B, a section view along the line 13B-13B of FIG. 13A, the diffuser 40 consists of a plurality of absorbing elements 45 (R=0), a plurality of reflecting elements 46 (R=+1), and a plurality of quarter wells 47 (R=−1) having bottom surfaces 48 parallel to the facing surfaces of the reflecting and absorbing elements.

Figure 14A:
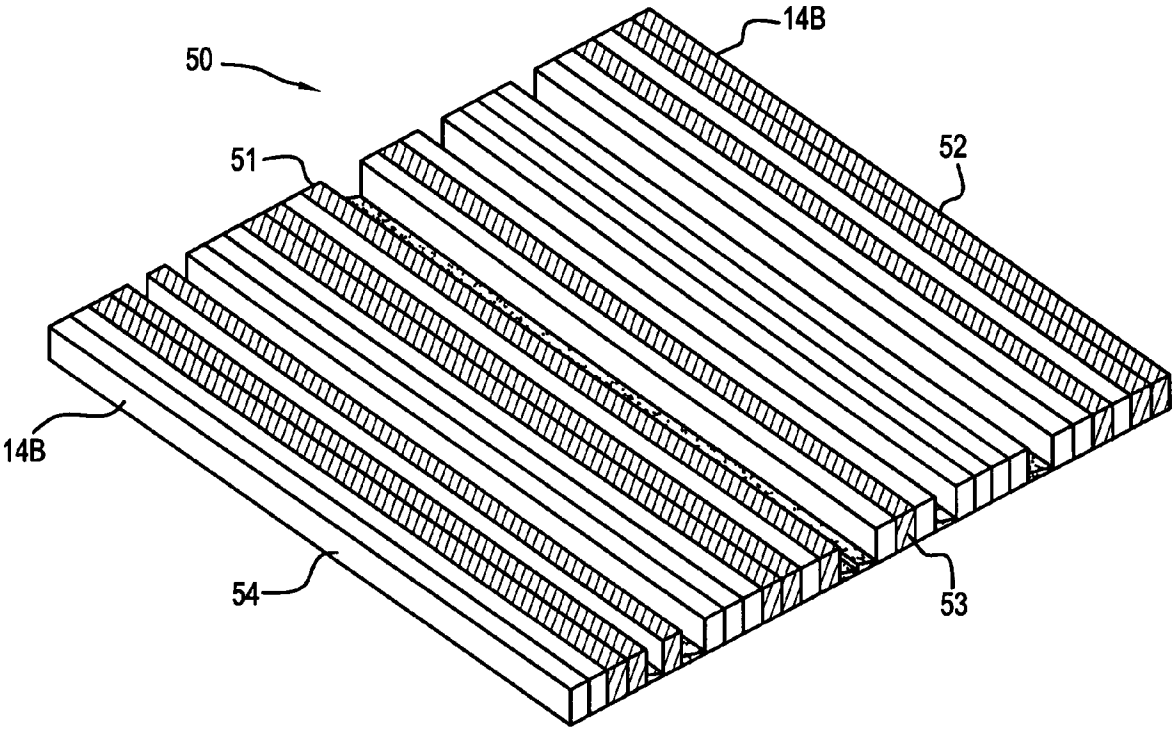
FIGS. 14A and 14B show isometric and section views, respectively, of an embodiment for an N=31 ternary diffuser with slanted wells, which scatters in a single plane
Figure 14B:
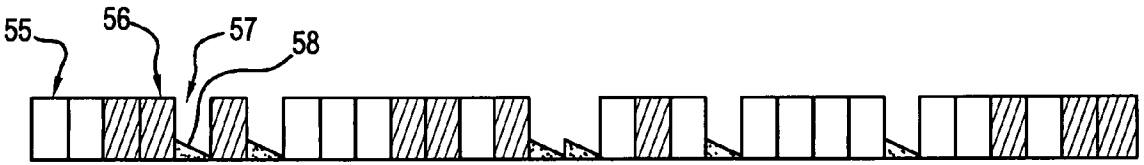

FIGS. 14A and 14B show an N=31 ternary diffuser generally designated by the reference numeral 50 and including a generally rectangular shape defined by walls 51, 52, 53 and 54. As best seen with reference to FIG. 14B, a section view along the line 14B-14B of FIG. 14A, the diffuser 50 consists of a plurality of absorbing elements 55 (R=0), a plurality of reflecting elements 56 (R=+1), and a plurality of quarter wells 57 (R=−1) having bottom surfaces 58 angled with respect to the facing surfaces of the absorbing and reflecting elements 56 and 55, respectively.

Figure 15A:
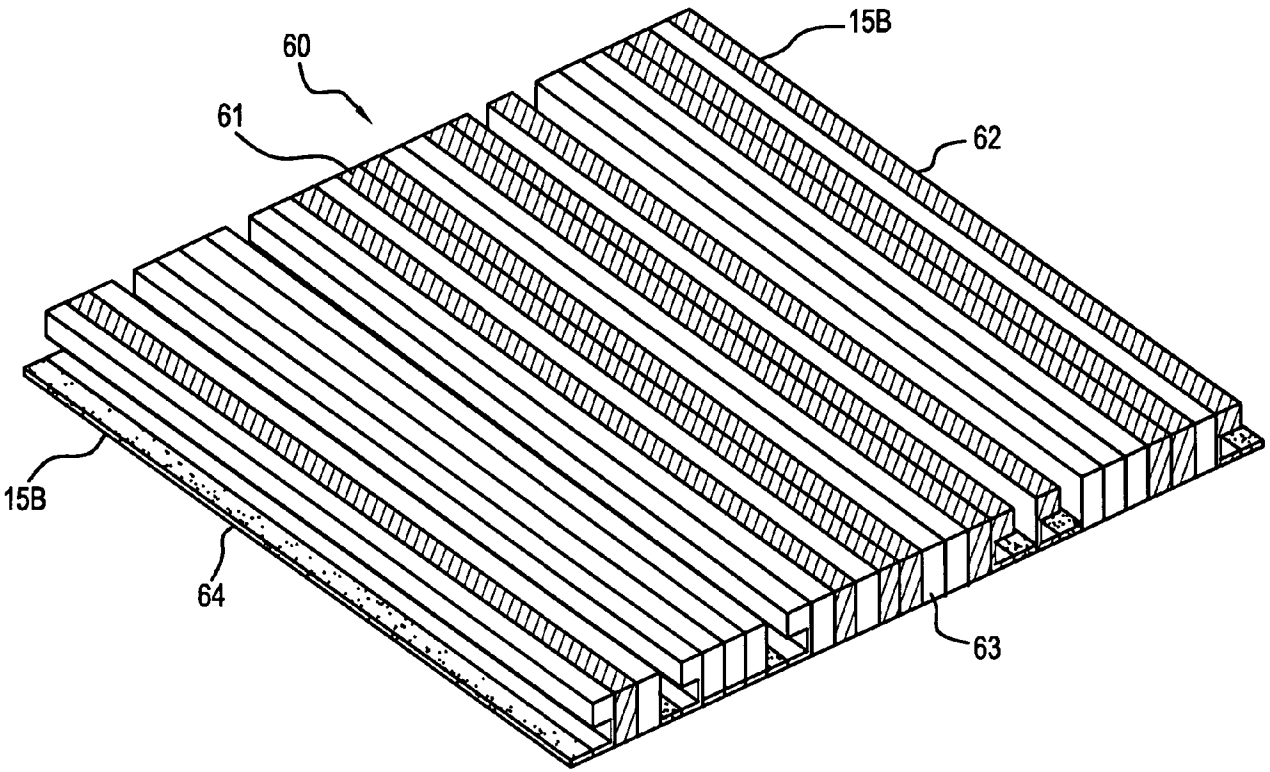
FIGS. 15A and 15B show isometric and section views, respectively, of an embodiment for an N=31 ternary diffuser with folded wells, which scatters in a single plane
Figure 15B:
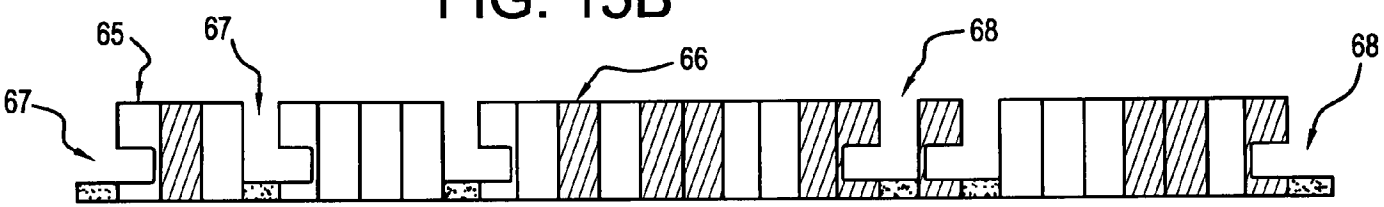

FIGS. 15A and 15B show an N=31 ternary diffuser generally designated by the reference numeral 60 and including a generally rectangular shape defined by walls 61, 62, 63 and 64. As best seen with reference to FIG. 15B, a section view along the line 15B-15B of FIG. 15A, the diffuser 60 consists of a plurality of absorbing elements 65 (R=0), a plurality of reflecting elements 66 (R=+1), and a plurality of quarter wells 67 (R=−1) that consist of "folded wells" of L-shaped cross-section. As seen in FIG. 15B, certain ones of the folded wells designated by the reference numeral 68 are mirror images, in cross-section, of others of the folded wells designated by the reference numeral 67.

Quaternary Diffusers

It is difficult to greatly improve the performance of the ternary diffusers at even multiples of the design frequency. Because the diffuser only has reflection coefficients of 0 and 1 at these frequencies, the attenuation of the specular lobe is limited. To overcome this, more well depths need to be considered. It would be possible to get better performance at even multiples of the design frequency by implementing additional wells with different depths. For only a few absorbent wells and many different depth wells, it would be possible to use the index sequences suggested by Schroeder. However, this would complicate the construction of the surface, and the absorption coefficient would be relatively small. Another solution would be to use active elements. It has been shown that with active impedance technologies it is possible to create a reflection coefficient of −1 constant with frequency over a 3-4 octave bandwidth. However, the frequencies over which this can be achieved is limited to low-mid frequencies due to limitations of the active technologies, and, furthermore, active diffusers are prohibitively expensive.

Another solution would be to bend and shape the diffuser so the front face was no longer flat, and therefore use corrugation to break up the specular reflection. This has been shown to work for binary amplitude diffusers in U.S. Pat. No. 6,112,852.

It is also possible to deal with these problems with only one more well depth. Consequently, diffusers with four different reflection coefficients will be considered. At the design frequency, these coefficients should be R=−1, 0, +1 and ξ. It is assumed that the last coefficient, ξ, is generated by a rigid walled well of a certain depth, and consequently |ξ|=1, and the reflection from this well purely provides a phase change. In choosing an appropriate value for ξ, it is necessary to consider not just the design frequency, but also the effects at multiples of the design frequency; after all, the idea behind introducing this additional wave depth was to improve performance at even multiples of the design frequency. For instance, if ∠ξ=π/2 at the design frequency, which corresponds to a well an eight of a wavelength deep, then at twice the design frequency, this well will provide a reflection coefficient of R=−1. However, at four times the design frequency, it will provide R=+1 along with all the other wells that do not have absorption. Consequently, a poor performance at four times the design frequency would be expected. By using depths related by relatively prime fractions, e.g. ½, ⅓, ⅕, ⅐, etc. of the λ/4 well, or maybe rationals, e.g. ½, ⅗, 7/11, etc. or a number theoretic phase grating, would ensure that there are no frequencies in the audible frequency range for which all the non-absorbing parts of the diffuser reflect in phase. Consequently, at the design frequency the R=−1 wells are set to a depth of $\lambda/4$, and the $R=\xi$ are set to $\lambda/6$. This puts the frequency at which these two wells radiate in phase at 24 times the design frequency.

Choosing an appropriate number sequence for this design is no longer simple. While there are quadriphase sequences in number theory, these do not normally have zero terms in them. For a 31-element diffuser, there are too many combinations to exhaustively search all those available. Consequently, the approach used is to adapt the current ternary sequence. It is assumed that the same open area is required, and consequently the zeros in the sequence will be maintained in their current locations. Then all that remains is to determine which −1s and 1s in the sequence need to be changed to $\lambda/6$ wells. In the original ternary sequence, there are 16 −1s and 1s, and consequently, it is possible to search all possible combinations to find the appropriate arrangement. The search is for the best merit factor for the first five harmonics of the design frequency, as these are in the frequency range (1-5 kHz) of interest here.

Results

Figure 16:
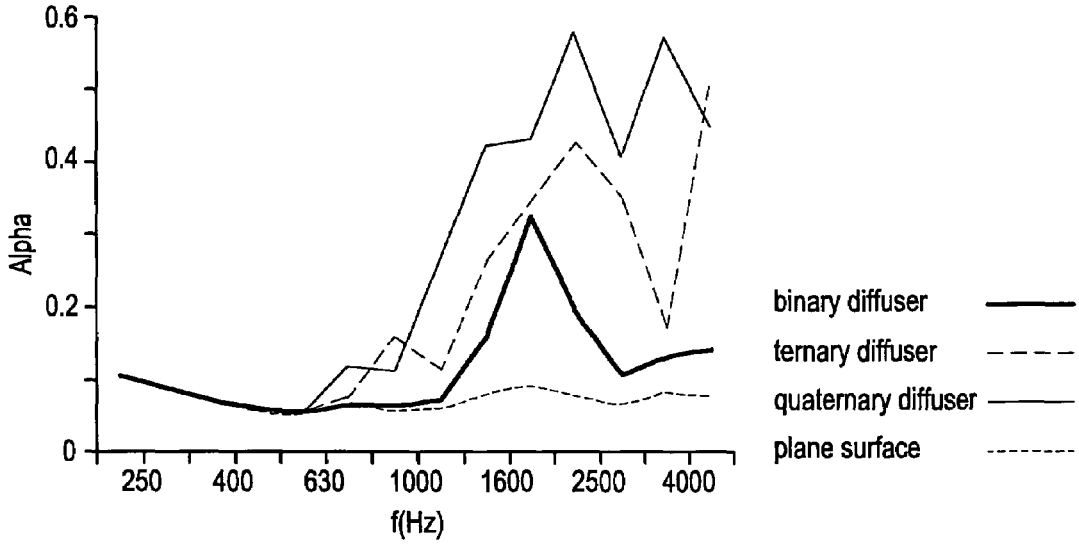
FIG. 16 shows diffusion coefficient for the four surfaces identified therein.
Figure 17:
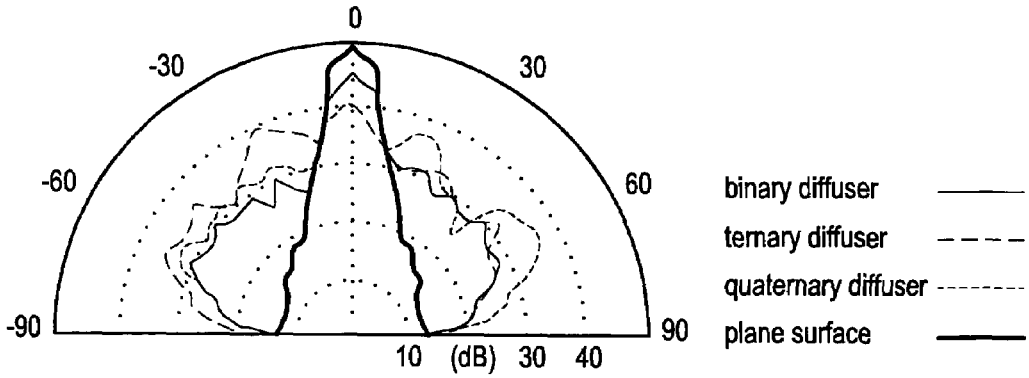
FIG. 17 shows scattering from the three identified diffusers and a plane surface at four times the design frequency.

FIG. 16 shows the diffusion coefficient verses frequency. The use of multiple well depths produces better scattering than the other diffusers except at 1 kHz, where the ternary diffuser performs better. However, this diffusion coefficient chart needs to be reviewed alongside the absorption coefficients shown in FIG. 12. Only above ≈2 kHz is the diffusion performance of these devices important, because in the frequency range 1-2 kHz that the absorption coefficient is too high, and the device are essentially just absorbers, and below that the surface has decreasing effect on the sound wave because it does not affect the wavefronts either by absorbing or diffusing. At frequencies, such as 4 kHz, where the unipolar and ternary diffusers produce identical scattering, the quad diffuser is performing better. The scattering at 4 kHz is shown in FIG. 17. The design is working as expected. The absorption coefficient (FIG. 12) is similar to that for ternary diffusers.

2D Hemispherically Scattering Hybrid Diffusers

So far this disclosure has been concerned with construction of diffusers that scatter in one plane. However, there are plenty of applications where diffusers with more hemispherical reflection patterns are required. Consequently, methods for constructing hemispherical ternary diffusers have been considered. To form an array, we need a two dimensional binary sequence. There are a variety of methods for constructing multidimensional binary arrays and ternary arrays have also been considered. However, the concern of most communication engineers is to maximize efficiency of the sequences, which means the number of zeros in the sequence is minimized. In the case of diffusers, however, our interest with hybrid absorbers is to allow some absorption, and so for this section, it is assumed that an array with 50% open area (50% efficiency) is needed because at high frequency this gives a nominal high frequency absorption coefficient of 0.5, which is typical for hybrid surfaces.

Consider constructing a ternary diffuser of dimensions N×M to be arranged in a periodic array. Whether a sequence can be constructed, depends on the values of N and M. There are three standard construction methods, folding, modulation (also known as Kronecker product) and periodic multiplication. There will be many array sizes that cannot be made with optimal autocorrelation properties.

Folding

Schroeder showed that a folding technique called the Chinese Remainder Theorem could be applied to phase grating diffusers based on polyphase sequences. D'Antonio used the same technique for a binary hybrid diffuser. This can also be applied to ternary sequences. To apply this process, N and M must be coprime. The requirement for 50% absorptive patches means a correlation identity derived ternary sequence must be used with length $NM=2^m-1$, with m being odd. The folding process wraps a 1D sequence into a 2D array and yet preserves the good autocorrelation and Fourier properties.

The 1D sequence, $a_k$, will be indexed using k=1,2,3,4 . . . NM. The elements of the 2D array are given by s(p,q) with:

$$s(p,q)=a_k$$
$$p=k \bmod N \tag{9}$$
$$q=k \bmod M$$

Consider the case of N=9 and M=7:

$$a_k=\{0, 0, 0, 0, 1, 0, 0, 0, 0, 1, 0, -1, 0, 0, 0, 0, 0, 0, -1, 0, 0, 0, 0, 1, 0, 0, 0, 0, 0, 0, 0, 0, 1, 0, 0, 0, 0, 0, 0, 0, 0, 1, 1, 1, 0, 1, -1, 0, 0, 1, 0, -1, 0, 0, 0, 0, 0, 1, -1, 0, 0, -1, 0, 0\}$$

The folded 2D array is then:

$$\begin{Bmatrix} 0 & 0 & 0 & 1 & -1 & 0 & 0 \\ 0 & 0 & 0 & 1 & -1 & 0 & 0 \\ 0 & 0 & 0 & 0 & 0 & 0 & 0 \\ 0 & 1 & 0 & 0 & 0 & -1 & 0 \\ 1 & 0 & -1 & 0 & 0 & 0 & 0 \\ 0 & 0 & 1 & 0 & 1 & 1 & 1 \\ 1 & 0 & -1 & 0 & 0 & 0 & 0 \\ 0 & 1 & 0 & 0 & 0 & -1 & 0 \\ 0 & 0 & 0 & 0 & 0 & 0 & 0 \end{Bmatrix}$$

Figure 18:
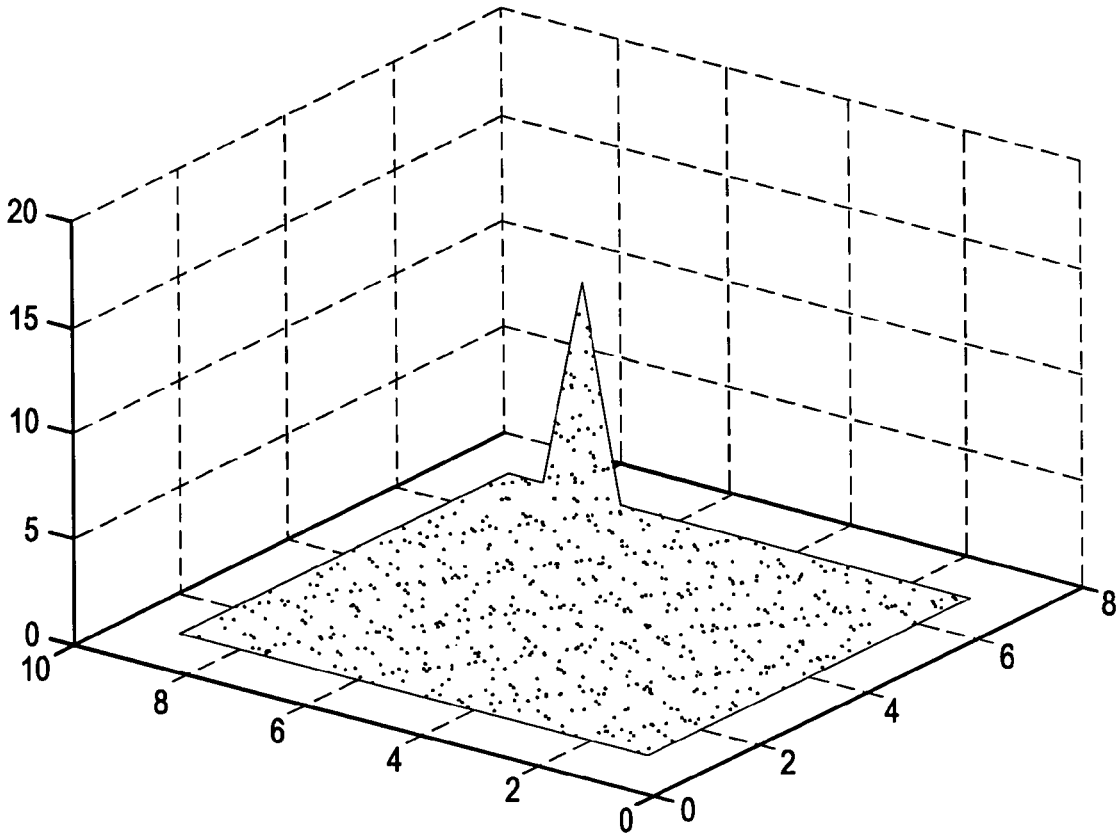
FIG. 18 shows a graph of the autocorrelation of a folded ternary diffuser array.

This folding technique still maintains the good autocorrelation properties of the sequence. For example, FIG. 18 shows the autocorrelation for the folded sequence. (Note, the sequence used to illustrate the technique here has too much absorption, with 75% absorbent patches).

The number of sequences, which can be constructed using this method with 50% absorbent patches, is rather limited as shown in Table 1 below, and consequently other construction methods are needed. However, the folding process is useful because it allows us to resize other arrays, as shall be shown later.

TABLE 1

Possible sequences lengths constructed using correlation identity derived ternary sequences and possible array sizes that can be achieved by folding for lengths less than $2^{16}$.

| N | m | Array sizes |
|---|---|---|
| 7 | 3 | — |
| 31 | 5 | — |
| 127 | 7 | — |
| 511 | 9 | 7 × 73 |
| 2047 | 11 | 23 × 89 |
| 8191 | 13 | — |
| 32767 | 15 | 7 × 31 × 151 |
| | | 217 × 151 |
| | | 31 × 1057 |
| | | 7 × 4681 |

Modulation

Modulation was a process that was used to allow the length of a sequence to be extended by modulating a single base shape with a binary sequence. A very similar process can be used to form arrays using ternary and binary sequences and arrays.

binary sequence, the one shown above. Table 2 below summarizes the array sizes that can be constructed by this method with ≈50% efficiency—again the allowable array sizes are rather few. Furthermore, as the resulting array sizes have N and M, which are not coprime, it is not possible to refold these arrays to get other sizes.

TABLE 2

Possible sequences lengths constructed by modulation of the correlation identity derived ternary sequences in Table 1 with the 2 × 2 perfect aperiodic binary array.

| N | Construction | Array sizes |
|---|---|---|
| 28 | N = 7 correlation identity derived ternary, m = 3, k = 1, e = l, with a perfect aperiodic binary array | 2 × 14 |
| 124 | N = 31, correlation identity derived ternary, m = 5, k = 1, e = 1, with a perfect aperiodic binary array | 2 × 62 |
| 508 | N = 127, correlation identity derived ternary, m = 5, k = 1, e = 1,, with a perfect aperiodic binary array | 2 × 254 |
| 2044 | N = 511, Correlation identity derived ternary, m = 9, k = 1, e = 1, with a perfect aperiodic binary array | 14 × 146 |
| 8188 | N = 2047, Correlation identity derived ternary, m = 9, k = 1, e = 1, with a perfect aperiodic binary array | 46 × 178 |
| 32764 | N = 8191, Correlation identity derived ternary, m = 13, k = 1, e = 1, with a perfect aperiodic binary array | 2 × 16382 |

Ternary and Binary Modulation

By modulating a ternary sequence with a perfect aperiodic binary array, a ternary array with optimal autocorrelation properties can be obtained; this process is a Kronecker product. Consider the length 7 correlation identity derived ternary sequence $\alpha=\{-1, 0, 0, 1, 0, 1, 1\}$, this is used to modulate the perfect aperiodic binary array b:

$$b = \begin{Bmatrix} -1 & -1 \\ -1 & 1 \end{Bmatrix}$$

to form a 2×14 length array c given by:

$$c = \begin{Bmatrix} 1 & 1 & 0 & 0 & 0 & 0 & -1 & -1 & 0 & 0 & -1 & -1 & -1 & -1 \\ 1 & -1 & 0 & 0 & 0 & 0 & -1 & 1 & 0 & 0 & -1 & 1 & -1 & 1 \end{Bmatrix}.$$

As the binary array has no zeros, the modulated array has the same proportion of absorbent patches as the original array −40% in this case. For longer ternary sequences, the proportion tends to 50%. This modulation preserves the original optimal autocorrelation properties with the sidebands of the autocorrelation being zero.

An issue that is not discussed in the number theory literature is the imbalance between the distribution of −1 and 1s in the sequence. This is important to diffuser design because the proportion of −1 and 1s change the amount of attenuation of the specular reflection at odd multiples of the design frequency. In this case, the modulation has produced an array c with a more even balance of −1 and 1s than the original sequence a, and consequently, it would be expected to perform better at attenuating the specular reflection; in this case an additional 6 dB of attenuation would be a rough first estimate.

Note, it is important to modulate the array by the sequence and not vice versa. There is only one known perfect aperiodic Ternary and Ternary Modulation The efficiency (proportion of zeros) of the derived array by modulation is a product of the efficiency of the original array and sequence. Consequently, it is possible to modulate a ternary array by a ternary sequence, provided the product of their efficiencies is around the design goal of 50%. Two aperiodic perfect ternary arrays with 67% zeros are:

$$d_1 = \begin{Bmatrix} 1 & 0 & 1 \\ 1 & 0 & -1 \end{Bmatrix} \tag{10}$$

$$d_2 = \begin{Bmatrix} 1 & 1 \\ 0 & 0 \\ 1 & -1 \end{Bmatrix}$$

Consequently, if either of these is combined with a ternary sequence with 75% zeros, we should obtain our overall design goal of a surface with 50% zeros.

The first problem is therefore to have a construction method, which allows the construction of the ternary sequence with the right efficiency. The correlation identity derived ternary sequences are not useful because they have too low an efficiency. On the other hand, some Ipatov ternary sequences and those based on the Singer difference sets are appropriate. If the efficiency goal is set to be between 45% and 55%, then there are four Ipatov ternary sequences that can be used of length, 13, 121, 31 and 781. These achieve an efficiency of 46%, 46%, 53% and 54% respectively. However there is an imbalance between the number of +1 and −1 in the sequence leading to somewhat less than optimal specular reflection absorption.

By combining two binary sequences based on Singer difference sets, it is possible to form a ternary sequence with the desired efficiency. The Singer difference set has parameters:

$$(N, k, \lambda) = \left(\frac{q^{2r+1}-1}{q-1}, \frac{q^{2r}-1}{q-1}, \frac{q^{2r-1}-1}{q-1}\right)$$

where N is the length of the sequence, k the number of 1s in the two binary sequences and λ the maximum side lobe autocorrelation of the two binary sequences. q and r are constants and are specified below. The efficiency of the ternary sequence formed by combining the binary sequences is given by:

$$\frac{q^{2r+1}-q^{2r}}{q^{2r+1}-1} \approx 1 - \frac{1}{q}$$

Since our requirement here is to find a sequence with ≈75% efficiency, q=4 is taken. This meets the requirement that $q=2^5$ where s is an integer.

Again, if we consider final arrays with a number of zeros between 45% and 55%, this limits the possible sequences to N=21, 341, 5461 . . . which are the cases for r=1, 2, 3 . . . Consider the case of N=21 for example. The two Singer difference sets for this case are[1]:

D1={3, 6, 7, 12, 14}

D2={7, 9, 14, 15, 18}

Two unipolar binary sequences of length 21 are formed; one based on D1, the other on D2. The rule is, that the sequence takes a value of 1, where the element index appears in the difference set, and takes a value of zero otherwise. For example, the sequence for D1 is:

a={−1, −1, 1, −1, −1, 1, 1, −1, −1, −1, −1, 1, −1, 1, −1, −1, −1, −1, −1, −1, −1} and for D2 is:

b={−1, −1, −1, −1, −1, −1, 1, −1, 1, −1, −1, −1, −1, 1, 1, −1, −1, 1, −1, −1, −1}

To form the ternary sequence, the cross-correlation between these two sequences is found:

$s_{ab}$={2, 0, 0, 1, 0, 2, 1, 1, 0, 2, 2, 0, 1, 2, 1, 2, 0, 2, 2, 2, 2}

The final sequence, c, is then given by:

$$c = \frac{s_{ab} - \frac{q^{2r-1}-1}{q-1}}{q^{r-1}}$$

which, in this case, yields:

c={1, −1, −1, 0, −1, 1, 0, 0, −1, 1, 1, −1, 0, 1, 0, 1, −1, 1, 1, 1, 1} which has autocorrelation properties of:

$s_{cc}$={16, 0, 0, 0, 0, 0, 0, 0, 0, 0, 0, 0, 0, 0, 0, 0, 0, 0, 0, 0, 0}

Having obtained the necessary ternary sequence, it is now possible to form the array. The sequence c is then modulated with the first perfect aperiodic ternary array $d_1$ shown in Equation (10) to form an array that has size 63×2 and has optimal autocorrelation properties with sidebands of zeros and a maximum value of 64. Hence, the absorption coefficient at high frequency in this case is nominally 0.51. The array has 28 values at −1 and 36 values at +1, and so there is good attenuation of the specular reflection at the design frequency and odd multiples of the design frequency.

It is more likely that array sizes, which are square, will be more useful. Because if the 63×2 diffuser is used periodically, the small repeat distance in one direction will reduce performance. By applying the Chinese Remainder Theorem, Equation (9), in reverse, it is possible to unfold this array into a 126×1 sequence, and then apply Equation (9) to refold it into two other array sizes which are more square: 18×7 and 14×9.

Periodic Multiplication

The final design process is to use periodic multiplication. Two arrays can be multiplied together to form a larger array. Consider array 1 to be s(x,y) of size $N_s \times M_s$ that has an efficiency of $E_s$, and array 2 to be t(x,y) of size $N_t \times M_t$ that has an efficiency of $E_t$. Then the new array is a product of the periodically arranged arrays, s(x,y)·t(x,y) of size $N_sN_t \times M_sM_t$ and the efficiency will be $E_s * E_t$. A necessary condition for this are that $N_s$ and $N_t$ are coprime, and so are $M_s$ and $M_t$, otherwise the repeat distance for the final arrays are the least common multiples of $N_s$ and $N_t$ in one direction and $M_s$ and $M_t$ in the other.

Figure 19:
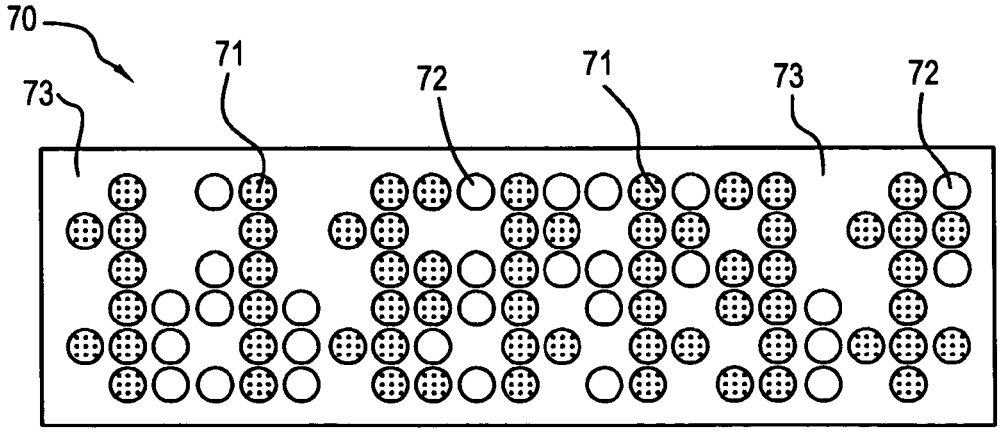
FIG. 19 shows a visualization of a 21×6 ternary array. Clear holes refer to an R=−1 well, dotted holes indicate an opening to a porous absorbent backing, R=0 and the shaded areas are reflective, R=1.

For example, the ternary sequence derived from Singer sets, c, can be folded into an array that is 7×3:

$$\begin{Bmatrix} 1, & 0, & 1 \\ 0, & 1, & 0 \\ -1, & 1, & -1 \\ -1, & 1, & -1 \\ 1, & 0, & 1 \\ -1, & 1, & -1 \\ 1, & 0, & 1 \end{Bmatrix}$$

that has an efficiency of 76%. This can then be multiplied by the ternary array $d_2$, which has efficiency of 67% to from a 21×6 array:

| | | | | | |
|---|---|---|---|---|---|
| 1 | 0 | 1 | 1 | 0 | 1 |
| 0 | 0 | 0 | 0 | 0 | 0 |
| −1 | −1 | −1 | 1 | 1 | 1 |
| −1 | 1 | −1 | −1 | 1 | −1 |
| 0 | 0 | 0 | 0 | 0 | 0 |
| −1 | −1 | −1 | 1 | 1 | 1 |
| 1 | 0 | 1 | 1 | 0 | 1 |
| 0 | 0 | 0 | 0 | 0 | 0 |
| 0 | −1 | 0 | 0 | 1 | 0 |
| −1 | 1 | −1 | −1 | 1 | −1 |
| 0 | 0 | 0 | 0 | 0 | 0 |
| 1 | 0 | 1 | −1 | 0 | −1 |
| −1 | 1 | −1 | −1 | 1 | −1 |
| 0 | 0 | 0 | 0 | 0 | 0 |
| 1 | 0 | 1 | −1 | 0 | −1 |
| 0 | 1 | 0 | 0 | 1 | 0 |
| 0 | 0 | 0 | 0 | 0 | 0 |
| −1 | −1 | −1 | 1 | 1 | 1 |
| 1 | 0 | 1 | 1 | 0 | 1 |
| 0 | 0 | 0 | 0 | 0 | 0 |
| 1 | 0 | 1 | −1 | 0 | −1 |

that has optimal autocorrelation properties and an efficiency of 51%. There is a slight imbalance between the number of −1 and 1s with 28 and 36 respectively of each. FIG. 19 shows a visualization of this sequence in a 21×6 ternary array generally designated by the reference numeral 70. In the array 70, the holes 71 which are depicted by a circle with a plurality of dots therewithin are meant to represent an opening to a porous absorbent backing (an absorbing element, R=0), the clear circles 72 are meant to represent quarter wells, R=−1, and the rest of the surface of the array 70, shaded in a dark color, and designated by the reference numeral 73, is meant to represent reflective elements R=+1.

This process can involve a binary array multiplied by a ternary array, or two ternary arrays multiplied together. Except for the perfect 2×2 binary array, perfect binary arrays will have an imbalance between the number of +1 and −1 terms, which could lead to an imbalance in the final array design. In general, perfect binary arrays have NM mod 4=0 and $NM=(2k)^2$ where k is an integer, and they have an imbalance of $\sqrt{NM}$.

Array Discussions

Once the array is formed, any periodic section can be chosen and many other manipulations can be done and still preserve the good autocorrelation. Procedures that can be done on their own or in combination include:

Using a cyclic shift to move the pattern around. s2(x, y)=s(x+u, y+v) where u and v are integers and the indexes x+u an y+v are taken modulo N and M respectively.

Mirror image the array s2(x, y)=s(±x,±y).

Invert the sequence s2(x, y)=−s(x, y).

Rotation s2(x, y)=s(y, $\bar{x}$)

Under sample the array, s2(x, y)=s(ux, vy), provided both u,N and v,M are coprime.

These will not change the acoustic performance, but may change the visual aesthetic. These techniques can be used to construct a hemispherically scattering ternary absorber-diffuser with commercial architectural acoustic applications. This embodiment, shown in FIGS. 20-25B, designated by the reference numeral 90, is formed by inverting the 21×6 sequence forming a 21×12 array and then mirror imaged to form a 21×24 array that is constructed into a typical 2'×2' wall or ceiling module. The array 90 bears some analogy to the element 40 illustrated in FIGS. 13A and 13B in that its quarter wells 93 have flat surfaces 94 that are generally parallel to the facing surfaces of absorbing elements 91 and reflecting elements 92.

Figure 20:
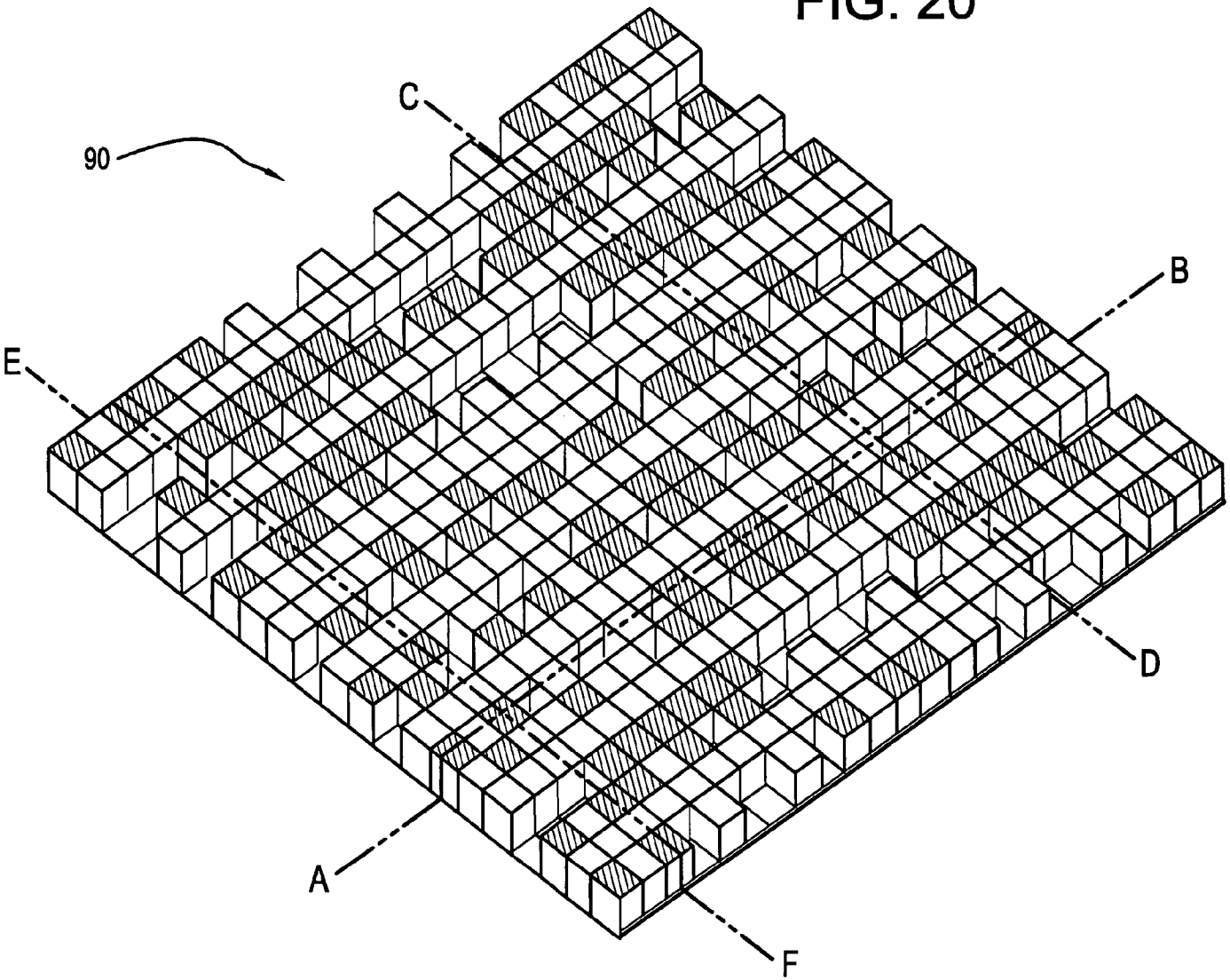
FIG. 20 shows an isometric view of a 21×24 hemispherically scattering embodiment of the 21×6 ternary array created by combining the 21×6 array with an inverted 21×6 array forming a 21×12 array and then mirroring this into a 21×24 square array with rectangular elements. The white patches are reflective (R=1), the light shade patches are absorptive (R=0) and the dark shaded patches are quarter wavelength wells (R=−1). Sections AB, CD and EF are identified.
Figure 21:
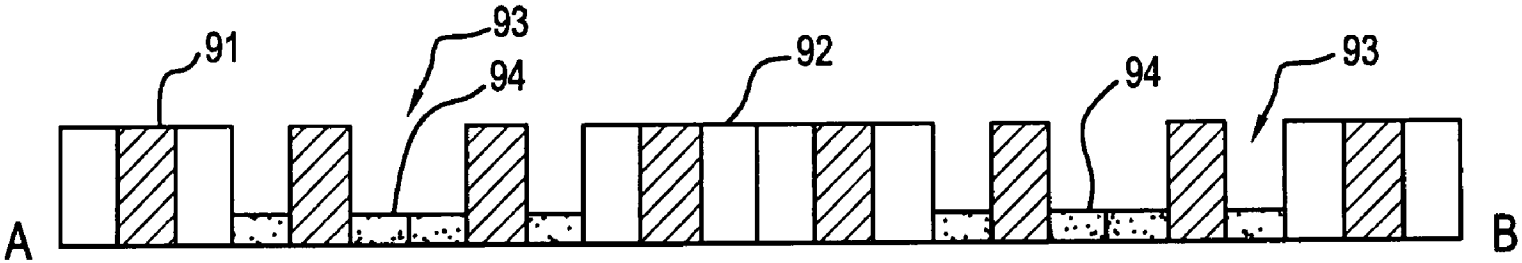
FIG. 21 shows the AB section identified in FIG. 20.
Figure 22:
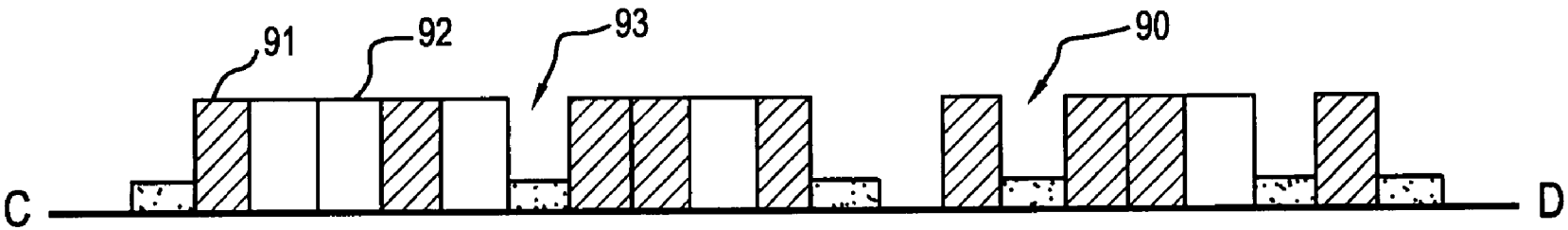
FIG. 22 shows the CD section identified in FIG. 20.

FIG. 20 shows an isometric view identifying section AB, shown in FIG. 21, and section CD, shown in FIG. 22. The section CD also shows absorbing elements 91, reflecting elements 92, and quarter wells 93.

Figure 23:
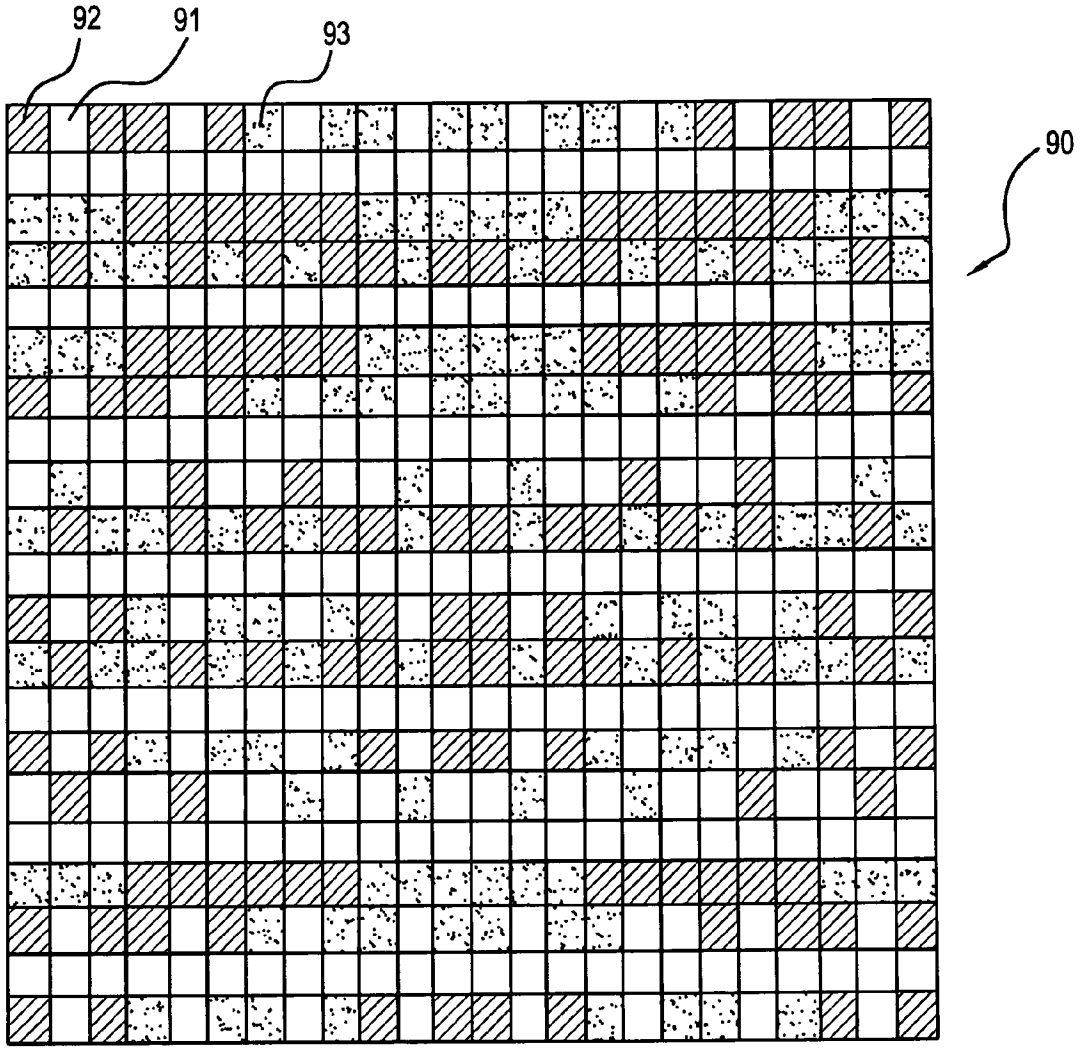
FIG. 23 shows a top view of diffuser in FIG. 20.

A top view is shown in FIG. 23, in which light shaded patches 91 are the R=0 absorptive areas, the white patches 92 are the R=+1 reflective areas, and the dark shaded patches 93 are the R=−1 quarter wave deep reflective areas. While the patches are shown as rectangular areas, in practice they can be any cross section, i.e., circular, triangular, etc. and any shape, i.e., flat, slanted, peaked, folded, etc. Also commercial samples may or may not be covered with an acoustically transparent textile or non-woven glass matt veil. The panels may also be fabricated in any size and thickness. Making the panel thicker, makes R=0 a better approximation of the pressure reflection coefficient and allows the quarter wavelength wells to suppress the specular lobe down to lower frequencies.

Figure 24A:
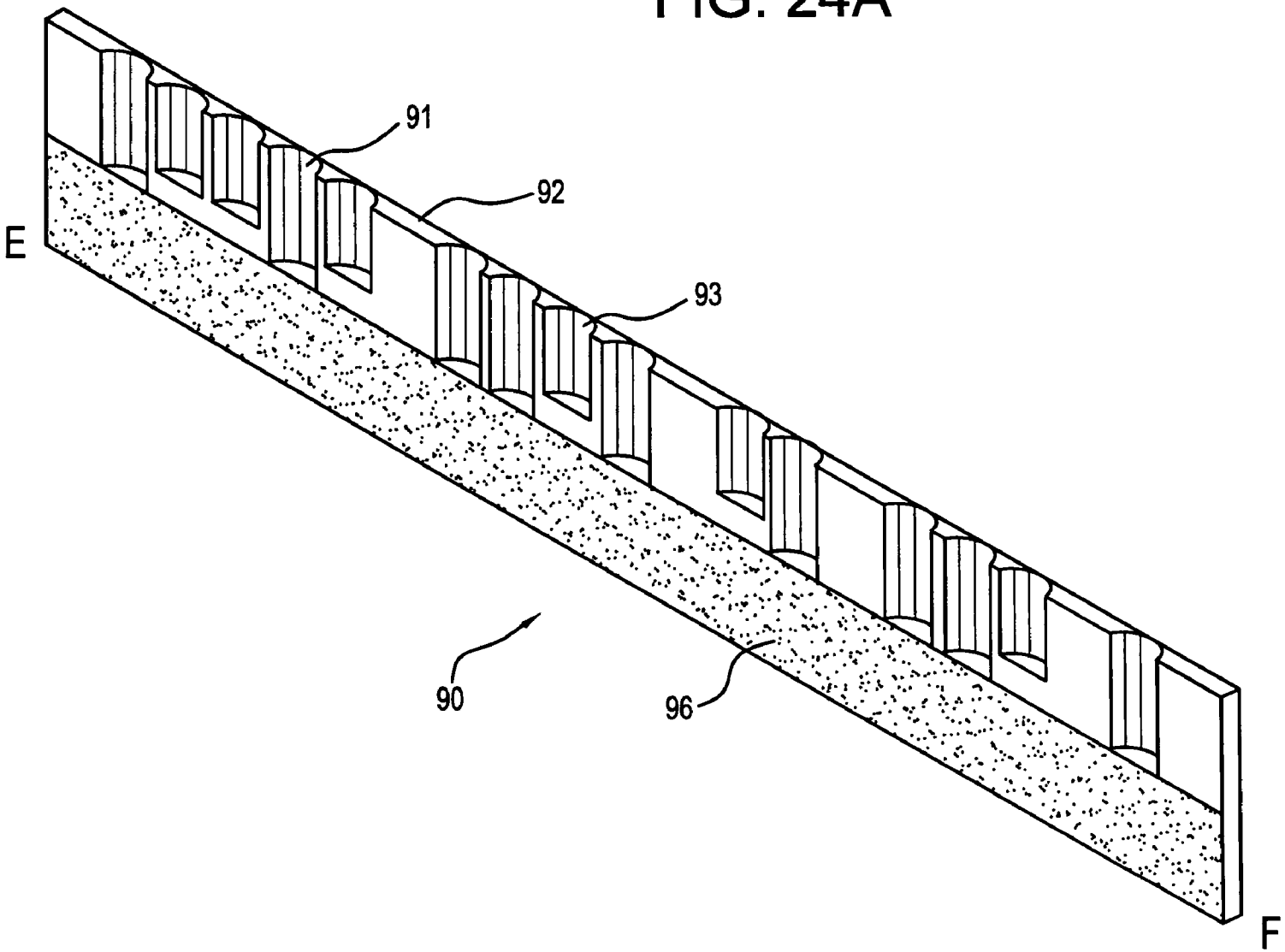
FIGS. 24A and 24B show a fabrication scheme using circular holes inscribed into the rectangular holes, for the section EF shown in FIG. 20 consisting of a thick perforated reflecting panel placed over an absorptive panel. The reflecting panel contains clear through holes accessing the absorbent backing for the R=0 wells and quarter wavelength deep holes for R=−1 wells. The reflective surface forms the R=1 areas.
Figure 24B:
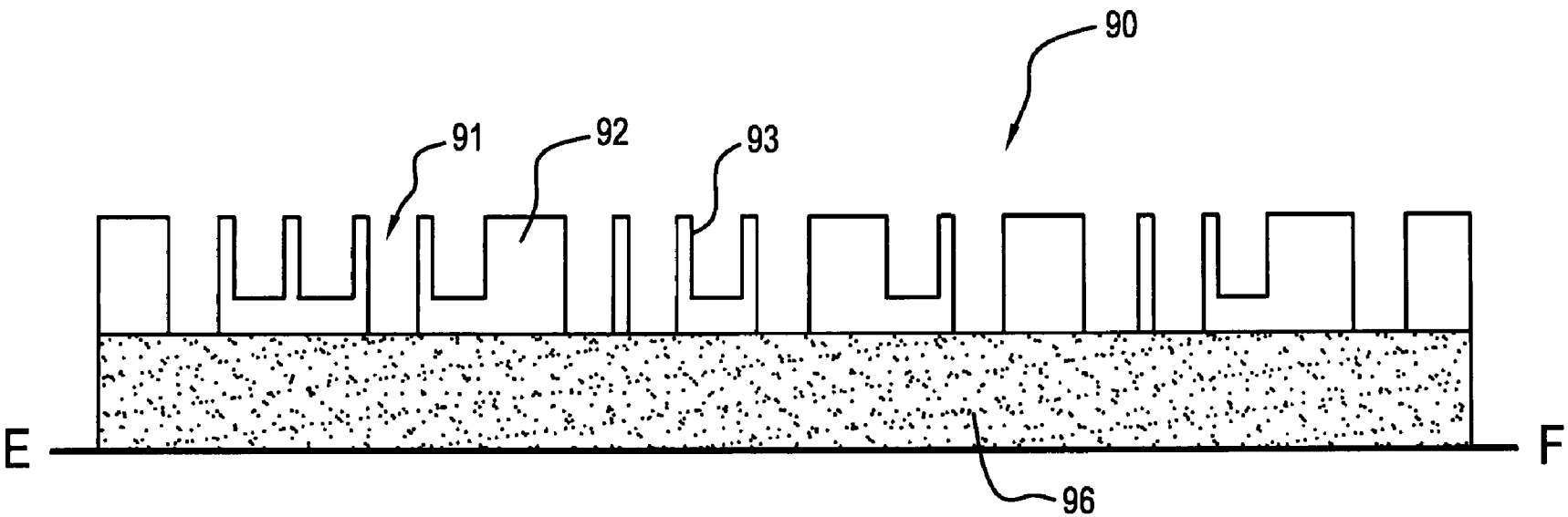

FIG. 24A illustrates one of many approaches to fabricating this embodiment, exemplified using the cross-section EF shown in FIG. 20. As shown in FIG. 24A, there are reflective areas 92, absorbing wells 91, and quarter wells 93. FIG. 24A shows a cross-section in perspective and FIG. 24B shows a front view of the same cross-section. Absorptive material is designated by the reference numeral 96. As seen in FIGS. 24A and 24B, the absorbing elements 91 provide access from the facing surface of the device 90 to the absorbing material 96. The rectangular patches shown in FIGS. 20 and 23 are modified by drilling circular holes for manufacturing ease, realizing the holes can assume any cross-section. The circles are inscribed in the rectangular areas leaving solid areas for panel stability. The panel consists of a hard layer, for example wood or MDF, with clear through holes accessing the absorbent backing forming the R=0 wells, quarter wavelength deep reflective holes forming the R=−1 wells and flat reflective areas forming the R=1 wells. Quaternary sequences could also be accommodated by introducing some ⅙ wavelength deep wells. Polyphase interference can also be achieved by drilling all of the R=−1 wells at different depths.

Figure 25A:
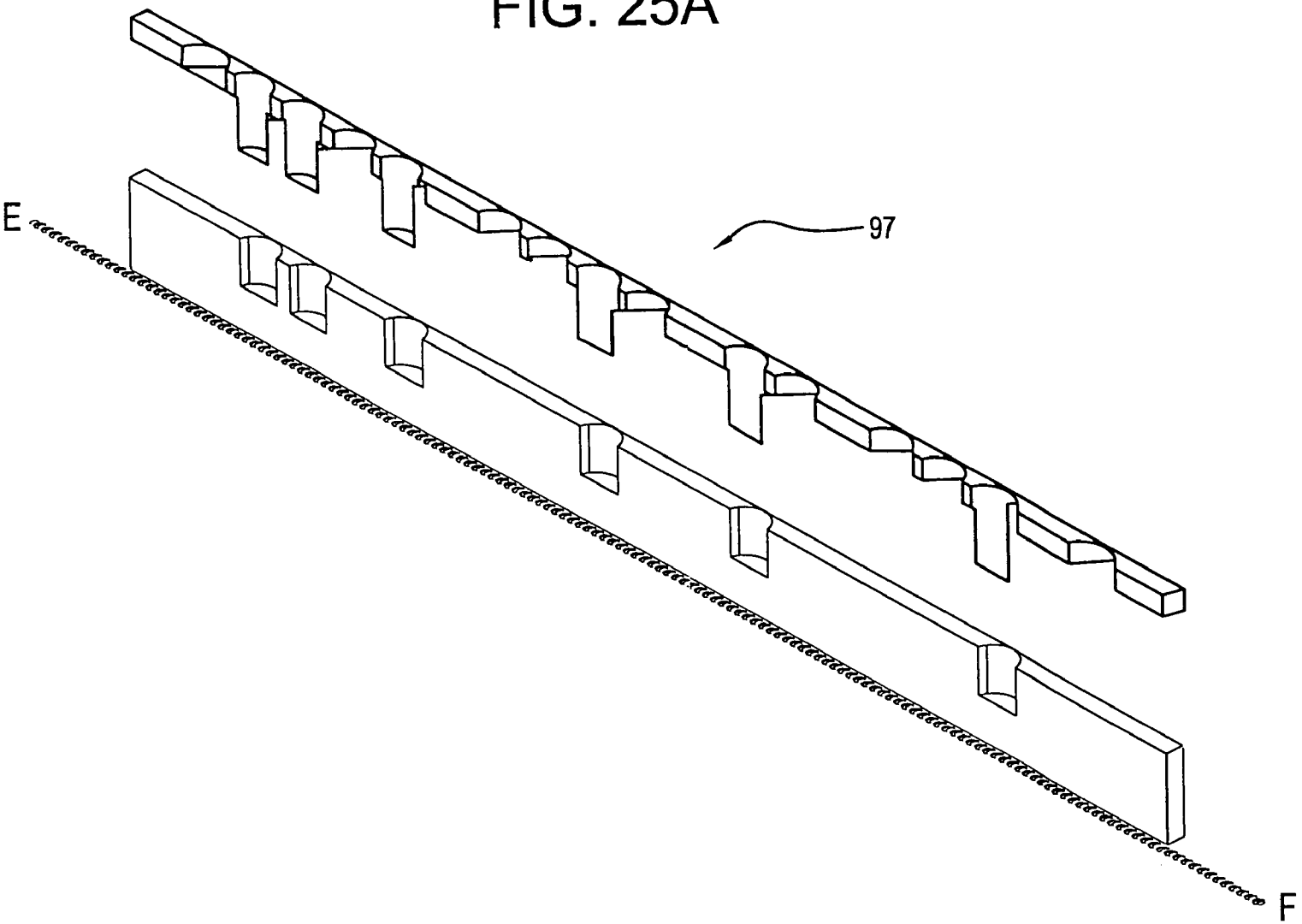
FIGS. 25A and 25B show a fabrication scheme using circular holes inscribed into the rectangular holes, for the section EF shown in FIG. 20, consisting of a thin perforated reflecting panel placed over an absorptive panel. The reflecting template contains clear through holes for the R=0 and R=−1 wells; however, the R=−1 wells are formed by insertion of a plug with a depth equal to a quarter wavelength at the design frequency. The reflective surface forms the R=1 areas.
Figure 25B:
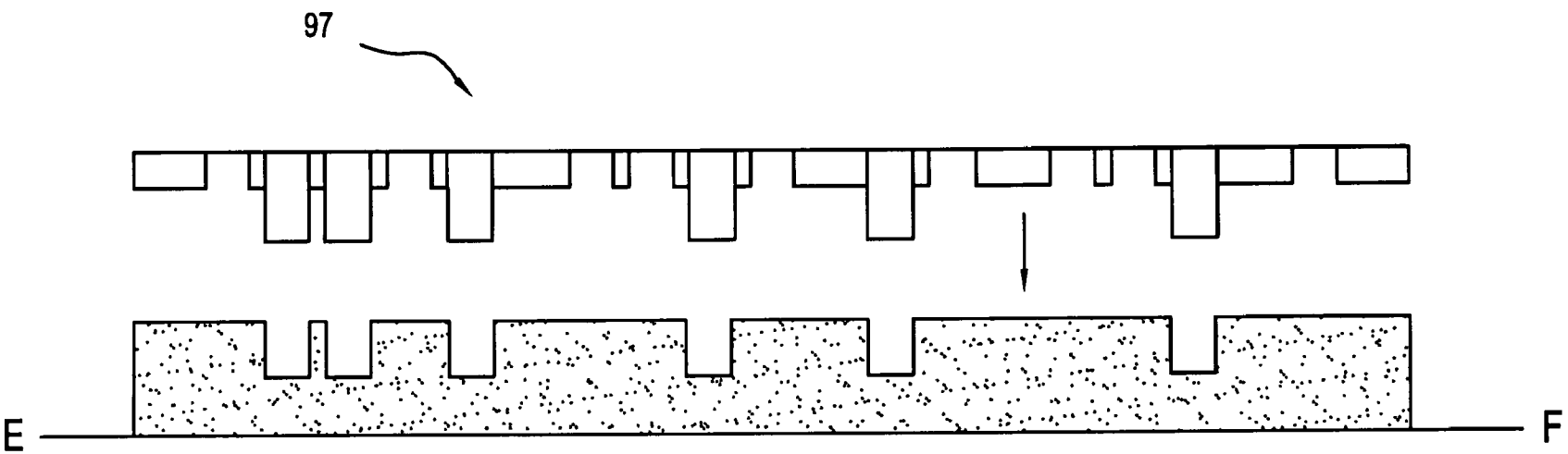

Another approach is shown in FIGS. 25A and 25B in which a thin template covering an absorbing panel is utilized. As before, circular holes are used for simplicity, realizing the holes can assume any cross-section. With particular reference to FIG. 25B, the thin template is generally designated by the reference numeral 97. Holes are located at the R=0 and R=−2 locations, and quarter wave deep reflective inserts are placed into the R=−1 hole locations. The R=1 reflective areas are simply left as is.

The main problem in forming hemispherical arrays is that there is only a limited set of arrays which provide optimal autocorrelation properties, the required efficiency to give the right absorption coefficient and have a reasonable balance between the number of −1s and 1s in the sequence leading to good suppression of the specular lobe. In work on binary sequences, it has been shown that by relaxing the requirement for optimal autocorrelation enables more different length sequences to be formed. This should also be possible for the ternary sequence case. For example, where there are a large number of elements in a sequence, it may be possible to truncate the sequence, losing 1 or 2 elements, and still gain good autocorrelation properties. This type of truncation might then give the right sequence length for folding into an appropriate array.

MODIFYING 2D BINARY AMPLITUDE DIFFUSORS

Figure 26A:
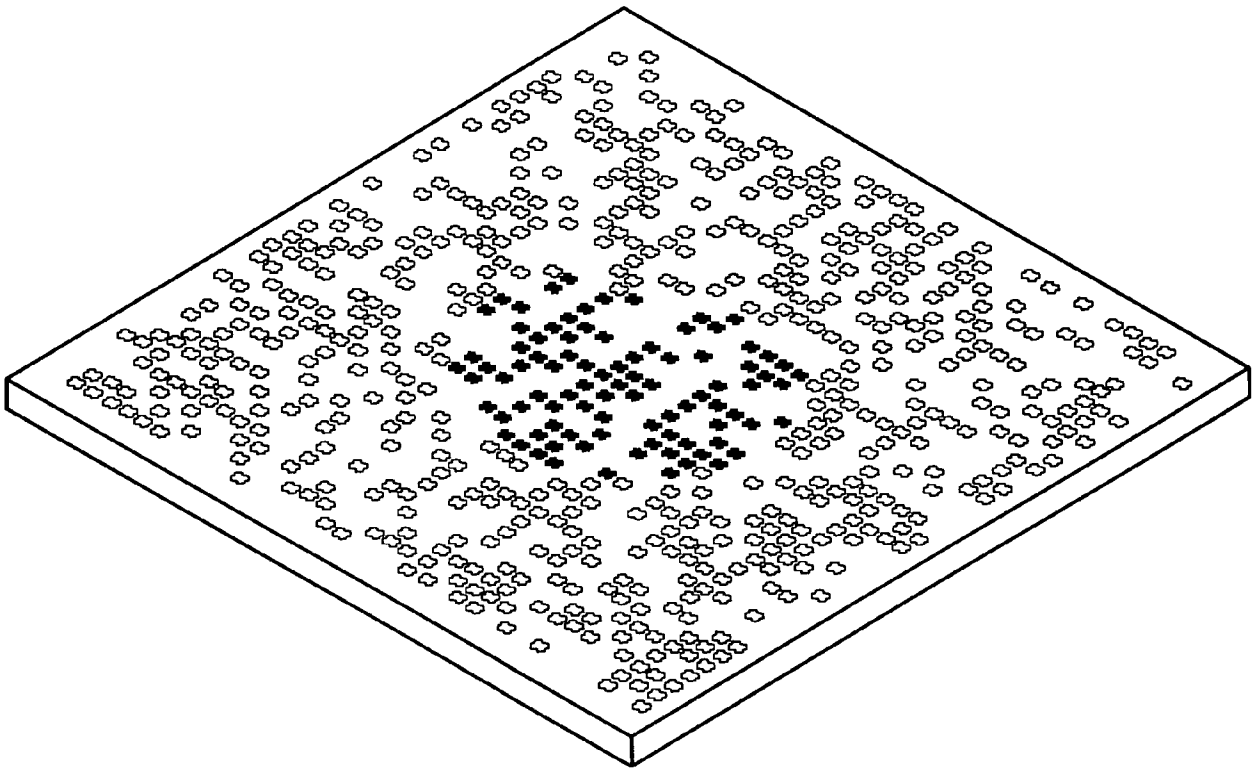
FIGS. 26A and 26B show an isometric view and section view, respectively, of a prior art binary amplitude diffusor with a hole cut in the absorbing backing panel.
Figure 26B:
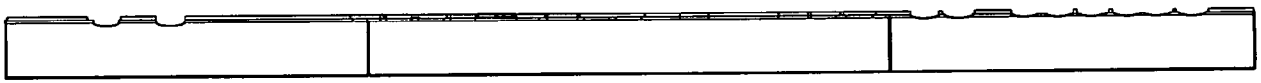
Figure 27:
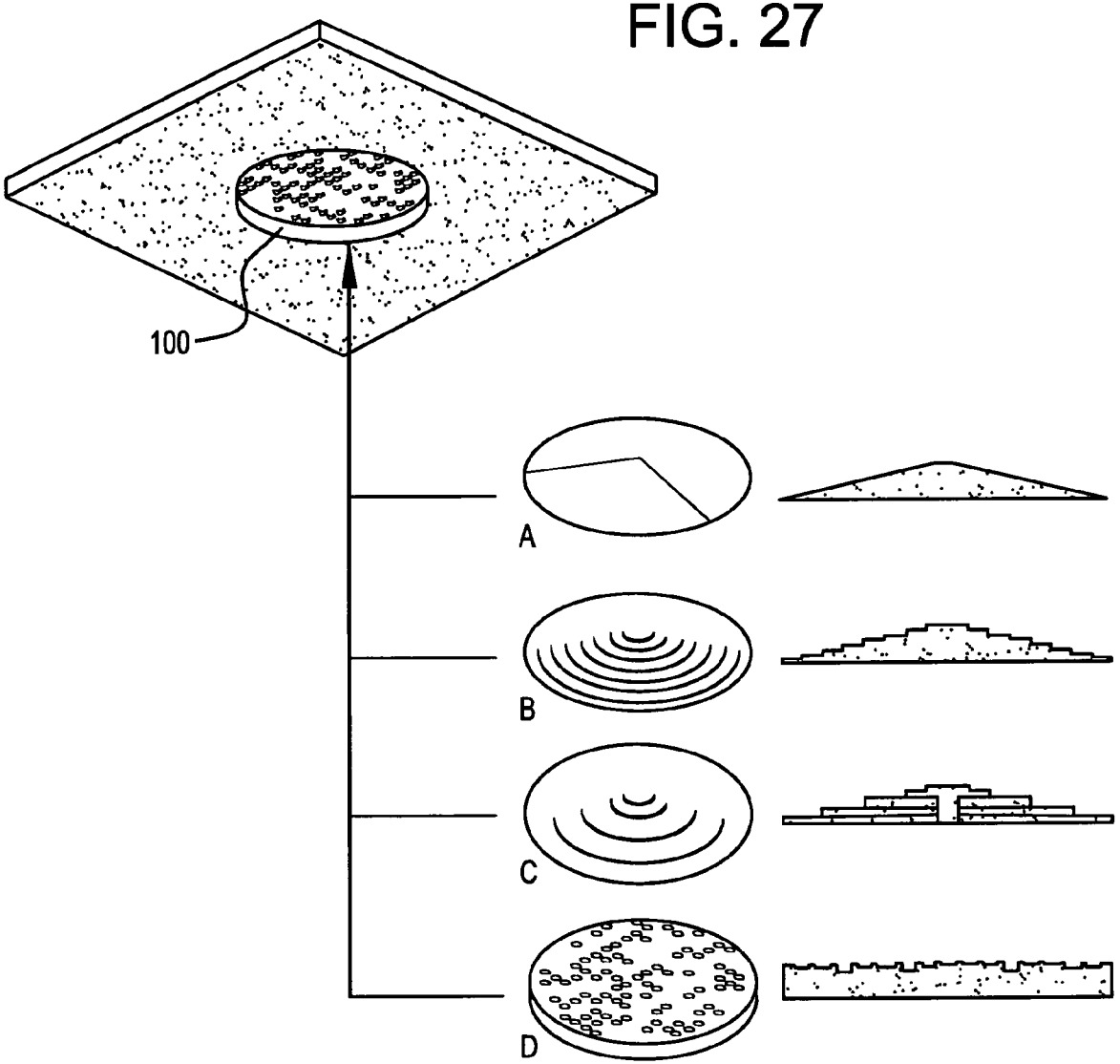
FIG. 27 shows an isometric rear view of the panel in FIG. 26A with visible cutout area, along with isometric and cross section views of four possible inserts. A is a simple ramp. B is a stepped ramp. C is a stepped ramp with folded wells and D is a polyphase surface with many different-depth quarter wavelength wells. All options are designed to provide interference at many design frequencies and odd multiples thereof, thus offering specular suppression over a wide range of frequencies.

Another approach that can be used to form hemispherically scattering hybrid diffusers is to modify binary amplitude diffusers (BAD panels). One embodiment of these surfaces consists of a mask or template placed over a porous absorbing material. The holes in the mask, which allow sound to access the rear-absorbing surface, offer a reflection coefficient of 0 and the non-hole areas offer a reflection coefficient of 1. One of the goals in BAD panel design is to decrease the absorption above 1 kHz and reduce the specular lobe. This approach addresses both of these goals. If we cut an 8-12"diameter hole in the rear fiberglass, the 0 wells will be converted to −1 wells, as shown in FIGS. 26A and 26B and 27. With particular reference to FIG. 27, the hole is designated by the reference numeral 100. Absorption is decreased by reducing the number of absorbing patches and the interference generated at the design frequency and odd multiples, due to the destructive interference caused by the quarter wave deep well. In effect, we have emulated a ternary sequence. Further improvement can be obtained by placing one of a variety of variable depth inserts into the opening in the fiberglass, as shown in FIG. 27. These inserts include a simple conical ramp (A) offering interference at a continuous range of frequencies above the design frequency of the maximum depth, an annular stepped ramp (B) offering interference at discrete frequencies, an annular stepped ramp with folded wells (C) offering interference at a range of frequencies, both below the design due to the longer folded wells, and above and finally an annular phase grating (D) made from holes drilled into a solid insert at a variety of prescribed depths offering interference at many frequencies above the design frequency. These prescribed depths can be determined by many approaches, including number theory sequences, relatively prime fractions, e.g., ½, ⅓, ⅕, ⅐, etc. of the λ/4 well, or rationals, e.g., ½, ⅗, 7/11, ect. of the λ/4 well to ensure that there are no frequencies in the audible frequency range for which all the non-absorbing parts of the diffuser reflect in phase. The effect of these attempts to add additional interference introduces many spikes to "fill in" the diffusion response, as shown in FIG. 8 for a simple ternary diffuser. Other modifications are also envisioned which offer different proportions of R=1 and R=−1 areas and different numbers of R=0 absorptive patches, to achieve different absorption efficiencies. As mentioned, the design frequency and its odd multiples can also be lowered by introducing folded wells into the stepped insert.

As such, an invention has been disclosed in terms of preferred embodiments thereof which fulfill each and every one of the objects of the invention as set forth hereinabove, and provide new and useful hybrid amplitude phase grating diffusers of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A hybrid amplitude-phase grating diffuser comprising:

a) a forward facing surface including:

i) a first plurality of absorbent patches; and ii) a second plurality of reflective patches;

b) said diffuser further including a reflective well;

c) said absorbent patches, reflective patches and reflective well combining together to form a variable impedance surface having pressure reflection coefficients of 0, 1 and −1, respectively.

2. The diffuser of claim 1, wherein said first plurality of absorbent patches and second plurality of reflective patches all have zero depth.

3. The diffuser of claim 2, wherein said reflective well has a depth comprising one-quarter of a wavelength at a design frequency of said diffuser.

4. The diffuser of claim 3, wherein said absorbent patches, reflective patches, and reflective well are arranged in a random or pseudo-random sequence, whereby sound scattered in a specular direction is suppressed by attenuation of the absorbent patches and destructive interference between said reflective patches and reflective well.

5. The diffuser of claim 4, wherein said absorbent and reflective patches are arranged in a ternary sequence, whereby sound scattered in a specular direction is suppressed by attenuation of the absorbent patches and destructive interference between said reflective patches and reflective well, more effectively than would be the case were the patches and well arranged in a random or pseudo-random sequence.

6. The diffuser of claim 5, wherein said ternary sequence is computer optimized to comprise the sequence 1 1 0 1 0 0 −1, where "1" signifies one of said absorbent patches, "0" signifies one of said reflective patches, and "1" signifies said reflective well.

7. The diffuser of claim 1, wherein said well comprises a plurality of wells, each having a depth of a quarter wavelength at a design frequency of said diffuser.

8. The diffuser of claim 5, wherein said ternary sequence comprises a 31 element correlation identity derived ternary sequence 0 0 1 1 −1 1 −1 0 0 0 1 1 0 1 −1 −1 0 1 0 −1 0 0 0 0 −1 0 0 1 0 1, where "0" signifies one of said absorbent patches, "1" signifies one of said reflective patches, and "−1" signifies said reflective well.

9. The diffuser of claim 8, further including means for scattering sound in a single plane.

10. The diffuser of claim 9, wherein said means for scattering sound comprises linear adjacent strips.

11. A hybrid amplitude-phase grating diffuser comprising:

(a) a forward facing surface including:

(i) a first plurality of absorbent patches; and (ii) a second plurality of reflective patches;

(b) said diffuser including a first reflective well having a first depth comprising a quarter wavelength at a design frequency of said diffuser;

(c) said diffuser further including a second reflective well having a second depth related to said first depth by a relationship chosen from the group consisting of (1) a fraction defined by a reciprocal of a prime number, (2) a rational fraction, and (3) a number theoretical phase grating, thereby ensuring that no sound waves reflecting from non-absorbing portions of said diffuser are in phase within an audible frequency range.

12. The diffuser of claim 11, wherein said absorbent patches, reflective patches, first reflective well and second reflective well combine together to form an impedance surface having pressure reflection coefficients of 0, 1, −1 and i, respectively.

13. The diffuser of claim 11, wherein said first reflective well comprises a plurality of wells with a first equal depth and said second reflective well comprises a plurality of wells with a second equal depth different from said first equal depth.

14. The diffuser of claim 11, wherein said patches are arranged according to a Quaternary sequence, with said first and second reflective wells providing destructive sound interference at odd and even multiples of said design frequency, respectively.

15. The diffuser of claim 11, wherein said first plurality of absorbent patches subtends up to 50% of a total area of said forwarding facing surface.

16. The diffuser of claim 6, 8 or 11, wherein a transition from absorption to diffusion occurs at about 1-2 kHz.

17. The diffuser of claim 6, 8 or 11, wherein said reflective well has a surface parallel to said forward facing surface.

18. The diffuser of claim 6, 8 or 11, wherein said reflective well has a surface angled with respect to said forward facing surface.

19. The diffuser of claim 6, 8 or 11, wherein said reflective well includes surfaces defining an "L" shaped chamber folded well.

20. The diffuser of claim 6, 8 or 11, wherein said diffuser comprises a first diffuser and a second diffuser.

21. The diffuser of claim 20, wherein said first diffuser has patches and a well arranged in a first ternary sequence and said second diffuser has patches and a well arranged in a second ternary sequence.

22. The diffuser of claim 21, wherein said second ternary sequence is inverted with respect to said first ternary sequence.

23. The diffuser of claim 22, comprising a relatively large modulated diffuser composed of said first and second diffusers arranged according to an optimal binary sequence in which a zero of said sequence refers to said first ternary sequence and a one of said sequence refers to said second inverted ternary sequence, thereby forming an aperiodic array using two base shapes.

24. The diffuser of claim 21, wherein said second ternary sequence is reversed with respect to said first ternary sequence.

25. The diffuser of claim 24, comprising a relatively large modulated diffuser composed of said first and second diffusers arranged according to an optimal binary sequence in which a zero of said sequence refers to said first ternary sequence and a one of said sequence refers to said second reversed ternary sequence, thereby forming an aperiodic array using a single base shape.

26. The diffuser of claim 20, wherein said patches and well of said first diffuser are arranged in a sequence 1 1 0 1 0 0 −1, where "1" signifies one of said absorbent patches, "0" signifies one of said reflective patches, and "−1" signifies said reflective well.

27. The diffuser of claim 20, wherein said patches and well of said second diffuser are arranged in a sequence −1 −1 0 −1 0 0 1, where "−1" signifies one of said absorbent patches, "0" signifies one of said reflective patches, and "1" signifies said reflective well.

28. The diffuser of claim 20, wherein said patches and well of said second diffuser are arranged in a sequence −1 0 0 1 0 1 1, where "−1" signifies one of said absorbent patches, "0" signifies one of said reflective patches, and "1" signifies said reflective well.

29. A ternary diffuser comprising:

a) a forward facing surface including:

i) a first area of absorbent patch subtending up to 50% of a total area of said surface; and ii) a second area of reflective patch;

b) said diffuser further including a reflective well;

c) said patches and well being arranged in a ternary sequence, whereby sound directed at said diffuser is scattered with a specular lobe of said sound being suppressed.

30. The diffuser of claim 29, wherein a transition from absorption to diffusion occurs at about 1-2 KHz.

31. The diffuser of claim 29, wherein distribution of locations of said areas and well is chosen at random.

32. The diffuser of claim 29, wherein distribution of said areas and well is chosen using optimization techniques for short sequences, and ternary and quaternary sequences for longer sequences.

33. The diffuser of claim 29, wherein said well comprises a plurality of wells.

34. The diffuser of claim 29, wherein said wells have depths chosen from the group consisting of (1) a constant quarter wavelength depth, (2) a series of depths related by fractions consisting of reciprocals of prime numbers or rationals, of a quarter wavelength well depth, and (3) a series of depths derived from a number theoretic phase grating.

35. The diffuser of claim 29, including means for scattering sound in a single plane.

36. The diffuser of claim 35, wherein said means for scattering comprises linear adjacent strips.

37. The diffuser of claim 35, wherein said means for scattering operates hemispherically with two-dimensional arrays of absorptive, reflective and quarter wave deep areas.

38. The diffuser of claim 29, wherein said well has a surface parallel to said forward facing surface.

39. The diffuser of claim 29, wherein said well has a surface angled with respect to said forward facing surface.

40. The diffuser of claim 29, wherein said well has a surface defining an L-shaped chamber.

41. A hemispherically-scattering, hybrid, ternary diffuser array comprising:

a) a forward facing 2-dimensional array surface including:

i) a first area of absorbent patch subtending up to 50% of a total area of said surface; and ii) a second area of reflective patch;

b) said diffuser further including a reflective well;

c) said first area of absorbent patch, second area of reflective patch and reflective well combining together to form a variable impedance 2-dimensional array having pressure reflection coefficients of 0, 1 and −1, respectively.

42. The diffuser of claim 41, wherein said first area of absorbent patch and second area of reflective patch all have zero depth.

43. The diffuser of claim 42, wherein said reflective well has a depth comprising one-quarter of a wavelength at a design frequency of said diffuser.

44. The diffuser of claim 43, wherein said absorbent patch area, reflective patch area, and reflective well are arranged in a random or pseudo-random sequence, whereby sound scattered in a specular direction is suppressed by attenuation of the absorbent patch area and destructive interference between said reflective patch area and reflective well.

45. The diffuser of claim 44, wherein said absorbent patch area, reflective patch area, and reflective well are arranged in a ternary sequence, whereby sound scattered in a specular direction is suppressed by attenuation of the absorbent patch area and destructive interference between said reflective patch area and reflective well, more effectively than would be the case were the patch areas and well arranged in a random or pseudo-random sequence.

46. The diffuser of claim 41, wherein said reflective well comprises a plurality of wells, each having a depth of a quarter wavelength at a design frequency of said diffuser.

47. The diffuser of claim 41, wherein said absorptive and reflective patch areas and reflective wells, each have a shape chosen from the group consisting of square, rectangular, circular and triangular.

48. The diffuser of claim 41, wherein the absorbent area, reflective area and reflective well are arranged in a 2-dimensional array, using folding techniques that convert 1-dimensional ternary sequences into 2-dimensional sequences.

49. The diffuser of claim 41, wherein the absorbent area, reflective area and reflective well are arranged in a 2-dimensional array, using binary and ternary modulation and periodic multiplication of ternary sequences.

50. The diffuser of claim 41 formed into a 21×24 array, further including means for scattering sound in a hemisphere, by array manipulation of a ternary 21×6 sequence derived from periodic multiplication of two appropriate MLS sequences.

51. The diffuser of claim 50 formed by forming holes of any cross-section into a hard surface layer formed from wood, plastic or medium density fiberboard (MDF), with clear through holes accessing an absorbent backing forming R=0 wells, quarter wavelength deep reflective holes forming R=−1 wells, and flat reflective areas forming R=1 wells.

52. The diffuser of claim 51, in which the quarter wavelength deep holes consist of two different depths, with R=0, R=1, R=−1 and R=ξ pressure reflection coefficients arranged according to a quaternary sequence, where ξ is a coefficient generated by a rigid-walled well of a certain depth with /ξ/=1.

53. The diffuser of claim 51, formed by drilling R=−1 wells at different depths according to an optimal number theory sequence.

54. The diffuser of claim 50 formed using a thin template covering an absorbing panel, with clear through holes of any cross-section drilled at R=0 and R=−2 locations, with quarter wave deep reflective inserts placed into R=−1 hole locations and R=1 reflective areas simply left as is.

55. In a two-dimensional binary amplitude diffuser including a flat uniform thickness panel and a forward facing surface, said forward facing surface including sound reflective areas and sound absorptive areas formed by holes through said panel, the improvement comprising a recess formed in a rear surface of said panel, said recess encompassing a plurality of said holes, and an acoustical insert received within said recess.

56. The diffuser of claim 55, wherein said panel is generally rectangular.

57. The diffuser of claim 55, wherein said recess is generally circular.

58. The diffuser of claim 56, wherein said recess is generally circular.

59. The diffuser of claim 55, wherein said holes have circular cross-section.

60. The diffuser of claim 55, wherein said insert comprises a simple conical ramp.

61. The diffuser of claim 55, wherein said insert comprises an annular stepped ramp.

62. The diffuser of claim 55, wherein said insert comprises an annular stepped ramp with folded wells.

63. The diffuser of claim 55, wherein said insert comprises an annular phase grating.

64. The diffuser of claim 41 or 50, comprising a first diffuser and a second diffuser.

65. The diffuser of claim 64, wherein said first diffuser has absorptive and reflective patch areas and wells arranged in a first ternary sequence and said second diffuser has absorptive and reflective patch areas and wells arranged in a second ternary sequence.

66. The diffuser of claim 65, wherein said second ternary sequence is inverted with respect to said first ternary sequence.

67. The diffuser of claim 65, comprising a relatively large modulated diffuser consisting of said first and second diffuser arranged according to an optimal binary sequence in which a zero of said sequence refers to said first ternary sequence and a 1 of said sequence refers to said second ternary sequence, said second sequence being inverted with respect to said first sequence, thereby forming an aperiodic array using two base shapes.

68. The diffuser of claim 65, wherein said second ternary sequence is rotated with respect to the first ternary sequence.

69. The diffuser of claim 68, comprising a relatively large modulated diffuser consisting of said first and second diffuser arranged according to an optimal binary sequence in which a zero of said sequence refers to said first ternary sequence and a 1 of said sequence refers to said second rotated ternary sequence, thereby forming an aperiodic array using a single base shape.

* * * * *